US007894765B2

(12) United States Patent
Okada

(10) Patent No.: US 7,894,765 B2
(45) Date of Patent: Feb. 22, 2011

(54) SHEET PROCESSING APPARATUS AND IMAGE FORMING APPARATUS FOR CONTROLLING A FOLDING OPERATION

(75) Inventor: Takayuki Okada, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 627 days.

(21) Appl. No.: 11/866,136

(22) Filed: Oct. 2, 2007

(65) Prior Publication Data

US 2008/0145120 A1 Jun. 19, 2008

(30) Foreign Application Priority Data

Dec. 18, 2006 (JP) ..... 2006-339863
Sep. 14, 2007 (JP) ..... 2007-239304

(51) Int. Cl.
*G03G 15/00* (2006.01)

(52) U.S. Cl. ..... 399/407; 270/4; 270/8; 283/68

(58) Field of Classification Search ..... 399/407; 283/68; 270/4, 8
See application file for complete search history.

(56) References Cited

U.S. PATENT DOCUMENTS 5,001,433 A * 3/1991 Osaki ..... 324/632
5,089,712 A * 2/1992 Holland ..... 250/557
5,169,376 A 12/1992 Ries et al.
5,699,163 A * 12/1997 Todoroki et al. ..... 356/445
6,003,853 A 12/1999 Nakazawa et al.
6,196,959 B1 3/2001 Jorg et al.
6,895,212 B2 * 5/2005 Yamakawa et al. ..... 399/407
2005/0248081 A1 * 11/2005 Gaissert et al. ..... 271/251

FOREIGN PATENT DOCUMENTS

EP 0160488 A3 * 6/1985

* cited by examiner

*Primary Examiner*—Daniel J Colilla
*Assistant Examiner*—Matthew G Marini
(74) *Attorney, Agent, or Firm*—Canon USA Inc IP Division

(57) ABSTRACT

A sheet processing apparatus includes a sheet storing portion configured to store a conveyed sheet, a folding portion configured to fold a sheet, and a controller configured to control the folding portion. The controller controls a folding operation of the folding portion according to information on a sheet fiber orientation relative to a sheet folding direction.

13 Claims, 20 Drawing Sheets

SHEET PROCESSING APPARATUS AND IMAGE FORMING APPARATUS FOR CONTROLLING A FOLDING OPERATION

BACKGROUND OF THE INVENTION

1. Field of the Invention

The present invention relates to a sheet processing apparatus having a finishing function configured to fold a sheet and an image forming apparatus including such a sheet processing apparatus.

2. Description of the Related Art

A conventional sheet processing apparatus having a sheet folding function includes a sheet storing portion, a folding roller pair, and an extrusion plate, as discussed in U.S. Pat. No. 5,169,376. In the sheet processing apparatus, sheets stacked and stored in the sheet storing portion are bound at its central part. Then, the bound portion is extruded to a nip portion of the folding roller pair by the extrusion plate, so that the sheets are folded into two and discharged.

Furthermore, as discussed in U.S. Pat. No. 6,003,853, regarding a sheet bundle having a large number of sheets, a fold portion of the sheet bundle is caused to pass through a folding roller pair twice depending on the number of sheets of the sheet bundle, so that the sheet bundle can be tightly folded. This mode is referred to as a double folding. By folding the sheet bundle twice, the folds can be strengthened enough to prevent the sheet bundle from being unfolded after the folding processing. Thus, a book binding with an acceptable appearance can be obtained.

Generally, a sheet used in copying machines or printers is what is generally called a cut sheet. During a sheet manufacturing process, a fiber orientation is made along a direction in which sheet fibers are blended. It is widely recognized that a close correlation exists between the fiber orientation and ease of folding a sheet.

FIGS. 20A and 20B illustrate a relationship between the fiber orientation of a sheet and the folding direction of a sheet. In FIGS. 20A and 20B, W represents a direction of sheet fibers being blended or, in other words, the fiber orientation. FIG. 20A illustrates a case where the folding direction is orthogonal to the fiber orientation. FIG. 20B illustrates a case where the folding direction is parallel to the fiber orientation.

If the folding direction is orthogonal to the fiber orientation as illustrated in FIG. 20A, a restoring force of sheet fiber acts in a direction to open the sheet bundle. For this reason, folding is relatively not easy and, as a result, a bookbinding quality deteriorates.

On the other hand, if the folding direction is parallel to the fiber orientation as illustrated in FIG. 20B, a force that acts to open the sheet bundle is relatively not affected by the sheet fibers. Thus, it is easier to fold the sheet bundle, and a bookbinding quality is high. Even sheet bundles having the same paper type (grammage) and the same number of sheets may differ in ease of folding according to a difference in relationship between the fiber orientation and the folding direction. Thus, there arises a difference in visual quality of a sheet bundle and bookbinding quality.

In an apparatus discussed in U.S. Pat. No. 6,003,853, a folding mode is selected from single folding and double folding according to the number of sheets. For this reason, even when the fiber orientation is parallel to the folding direction and, thus, a sufficient folding quality can be obtained by single folding, double folding mode may be selected, thus requiring longer bookbinding time. On the other hand, even when the fiber orientation is orthogonal to the folding direction and, thus, double folding is desirable, single folding mode may be selected depending on the number of sheets. This results in an insufficient folding quality.

SUMMARY OF THE INVENTION

The present invention is directed to a sheet processing apparatus that is capable of improving a folding quality of a sheet and reducing bookbinding time by controlling a folding operation based on information on a sheet fiber orientation relative to a sheet folding direction.

According to an aspect of the present invention, a sheet processing apparatus includes a folding portion configured to fold a sheet, and a controller configured to control the folding portion. The controller controls a number of times of folding to be performed by the folding portion according to information on a sheet fiber orientation relative to a sheet folding direction.

According to an exemplary embodiment of the present invention, since an optimum bookbinding condition can be set based on information on a sheet fiber orientation relative to a sheet folding direction, a bookbinding quality can be efficiently improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
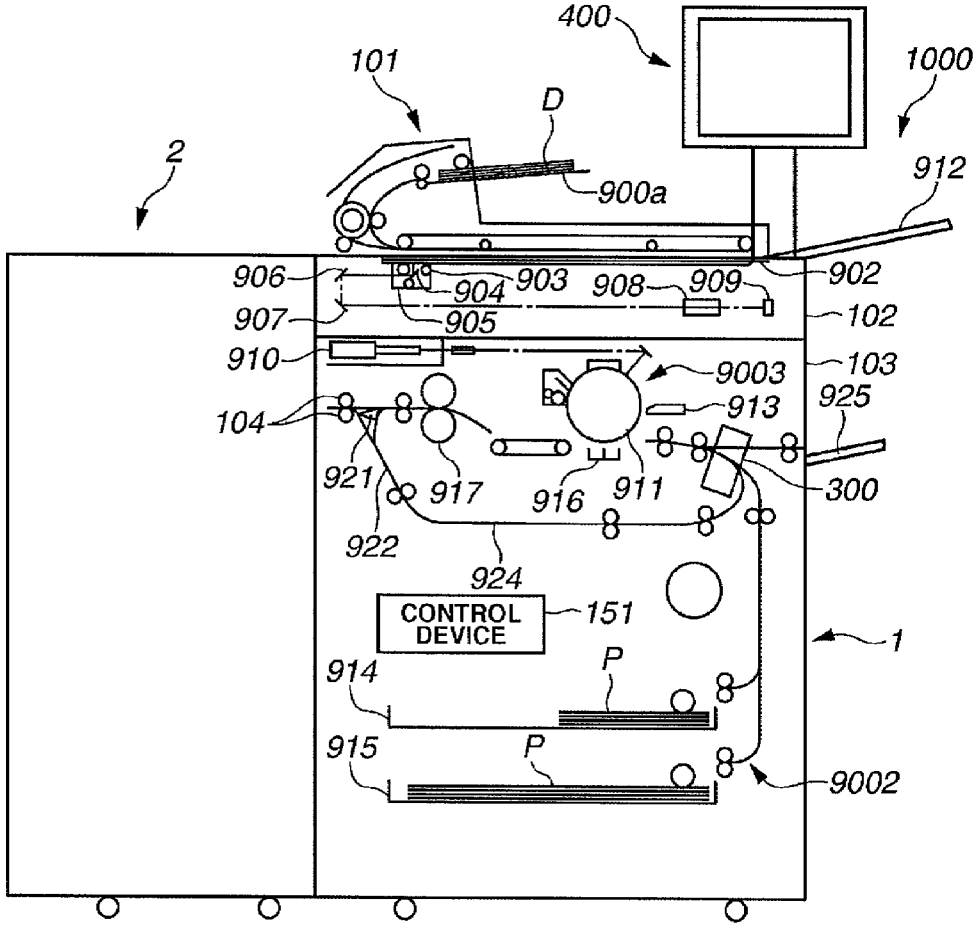
FIG. 1 illustrates a sectional view of an example image forming apparatus to which a sheet processing apparatus according to an exemplary embodiment of the present invention can be applied.

First, an image forming apparatus to which a sheet processing apparatus according to an exemplary embodiment of the present invention can be applied will be described with reference to FIG. 1. An image forming apparatus 1000 illustrated in FIG. 1 is a digital copying machine. The digital copying machine 1000 includes an image forming apparatus main body 1 and a finisher 2 (bookbinding apparatus), which serves as a sheet processing apparatus. The image forming apparatus main body 1 includes a printer portion 103, a reading portion 102 arranged on the top face of the printer portion 103, and a document feeder 101 configured to feed a document to the reading portion 102.

The reading portion 102, which is configured to read an image of a document, includes a scanner unit 904, mirrors 905, 906, and 907, a lens 908, and an image sensor 909. When an operator scans a document D with the reading portion 102, the operator sets the document D on a document tray 900*a* of the document feeder 101. At this time, the operator sets the document D on the document tray 900*a* with an image-formed surface facing upside.

The document feeder 101 conveys sheets of the document D one by one to the left, as viewed in FIG. 1, from the first page. The document D is conveyed through a curved path and over a platen glass 902 from left to right, and finally discharged onto a discharge tray 912.

When the reading portion 102 reads an image of the document D, which is being conveyed by the document feeder 101, the scanner unit 904 stays at a predetermined position and the document D is conveyed from left to right over the scanner unit 904.

In such reading processing, a lamp 903 of the scanner unit 904 emits light onto the document D when the document D passes over the platen glass 902. Light reflected from the document D reaches the image sensor 909 via the mirrors 905, 906, and 907, and the lens 908. Image data of the document D, which is read for each line by the image sensor 909, is then sent to an exposure device 910.

On the other hand, reading of a document can also be performed by allowing the document D conveyed by the document feeder 101 to temporarily stay on the platen glass 902 while the scanner unit 904 moves from left to right. Further, in a case where an operator scans a document without using the document feeder 101, the operator lifts up the document feeder 101, sets the document on the platen glass 902, and then scans the document.

The printer portion 103, which is configured to form an image on a sheet, includes a sheet feeding portion 9002 configured to feed a sheet P stored in cassettes 914 and 915, and an image forming portion 9003 configured to form an image on a sheet P fed by the sheet feeding portion 9002.

The image forming portion 9003 includes a photosensitive drum 911, a developing device 913, and a transfer charging device 916. In forming an image, a laser beam from the exposure device 910 is emitted onto the photosensitive drum 911, so that a latent image is formed on the photosensitive drum 911. A toner image corresponding to latent image is formed by the developing device 913. A fixing device 917 and a discharge roller pair 104, etc., are arranged downstream of the image forming portion 9003.

An operation display device 400, which is mounted on the top surface of the image forming apparatus main body 1, includes a plurality of keys used for setting various functions for image forming and a display portion used for displaying a state of setting.

Next, an example image forming operation of the image forming apparatus main body 1 will be described. First, as described above, image data of the document D, which is read by the image sensor 909 of the reading portion 102, is sent to the exposure device 910 after being subjected to a predetermined image processing. Then, the exposure device 910 outputs a laser beam corresponding to the image signal.

The laser beam scans the photosensitive drum 911 via a polygonal mirror 910*a*. Accordingly, an electrostatic latent image corresponding to the laser beam is formed on the photosensitive drum 911. Then, the electrostatic latent image is developed and visualized as a toner image by the developing device 913.

On the other hand, a fiber orientation of the sheet P, which is conveyed from any one of the cassettes 914 and 915, a manual feed portion 925, and a two-sided conveying path 924 is detected by a fiber orientation detection sensor 300 serving as a fiber orientation detecting device. The fiber orientation detection sensor 300, which will be described below in detail, is arranged downstream of a position where paper paths of the cassettes 914 and 915 and the manual feed portion 925 join together. Then, the sheet P is conveyed to a transfer portion including the photosensitive drum 911 and the transfer charging device 916. At the transfer portion, the visualized toner image on the photosensitive drum 911 is transferred to the sheet P. Then, the toner image is fixed by the fixing device 917. The sheet P with a fixed toner image is discharged to the finisher 2 by the discharge roller pair 104.

In a case where a sheet P having a toner image is discharged face-down from the image forming apparatus main body 1, the sheet P, which has passed through the fixing device 917, is first led to a path 922 by a flapper 921. Then, at the timing when the trailing edge of the sheet P passes the flapper 921, the sheet P is switch-backed, conveyed to the discharge roller pair 104 through the flapper 921, and discharged from the image forming apparatus main body 1.

In this way, the sheet P with a toner image facing down is discharged from the image forming apparatus main body 1. According to an inversion discharge, by which the sheet P is discharged face down, when images are formed from the first page with the document feeder 101 used, the image-formed sheets can be arranged in order of page. Furthermore, even when images are formed using image data from a computer, the image-formed sheets can be arranged in order of page.

When an image is formed on an inflexible sheet P conveyed from the manual feed portion 925, the sheet P is not conveyed to the path 922 but is discharged from the image forming apparatus main body 1 by the discharge roller pair 104 with the toner image facing up. Such an inflexible sheet is, for example, a transparency used for an overhead projector.

When an image is formed on both surfaces of the sheet P, first, the sheet P is conveyed from the fixing device 917 towards the discharge roller pair 104. Then, immediately after the trailing edge of the sheet P passes the flapper 921, the sheet P is switched back and conveyed to the two-sided conveying path 924 through the path 922 by the flapper 921.

A sheet P discharged from the image forming apparatus main body 1 is then fed to the finisher 2 (bookbinding apparatus) serving as a sheet processing apparatus. The sheet processing apparatus binds the image-formed sheets or folds them.

Figure 5:
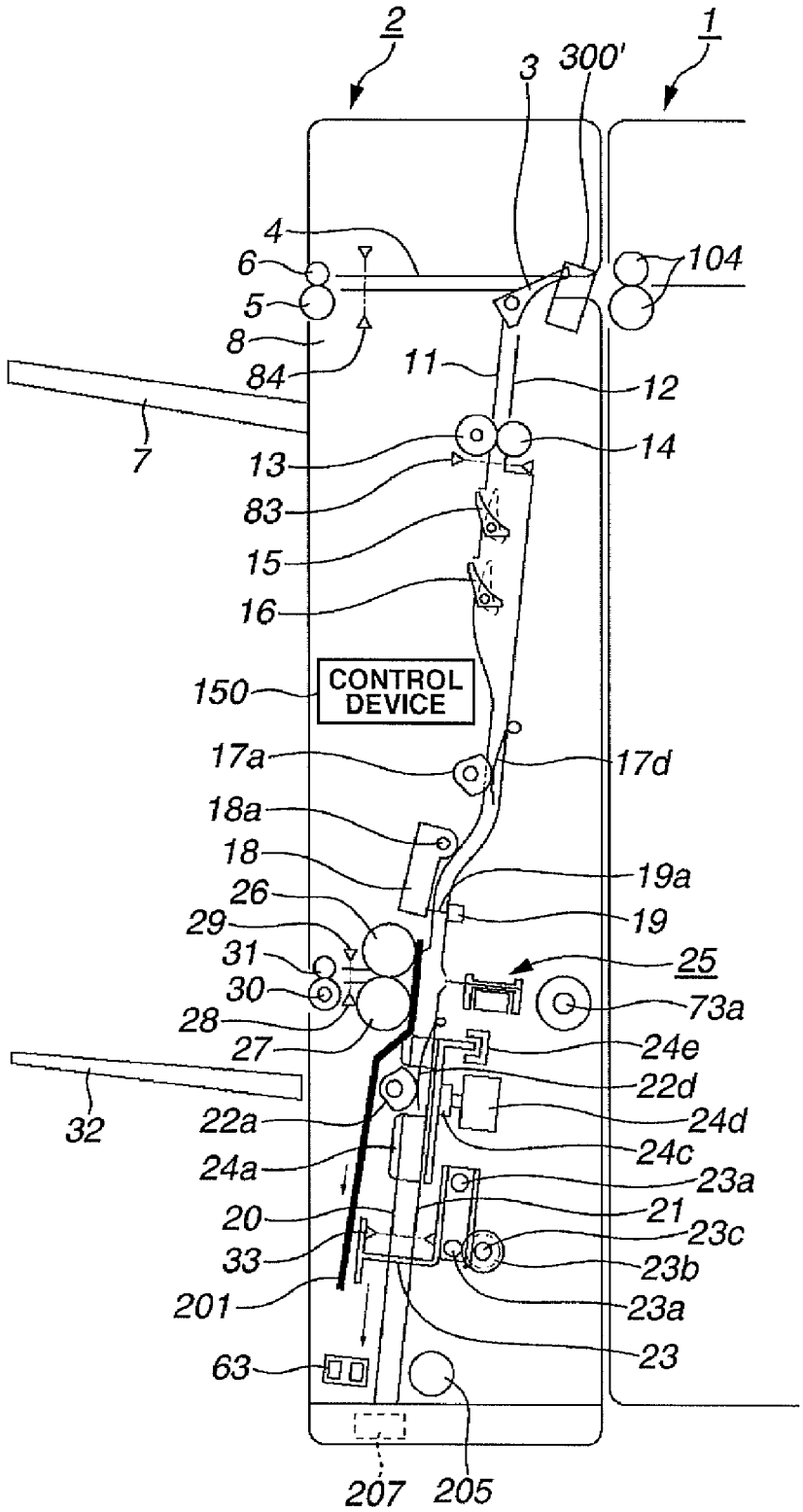
FIG. 5 illustrates a sectional view of an example sheet processing apparatus according to an exemplary embodiment of the present invention.

FIG. 5 illustrates an example sheet processing apparatus according to an exemplary embodiment of the present invention. A bookbinding mode or a stacking mode is switched by an inlet flapper 3 according to an on/off selection of an inlet solenoid 3*d* illustrated in FIG. 6.

A stacker discharge roller 5 and a stacker discharge roller 6 are provided downstream of a discharge path 4. A stacker tray 7 stacks sheets discharged from the stacker discharge roller 5. When the stacking mode is selected, the inlet flapper 3 changes its position and the sheet P discharged from the image forming apparatus main body 1 is conveyed along the discharge path 4.

Figure 6:
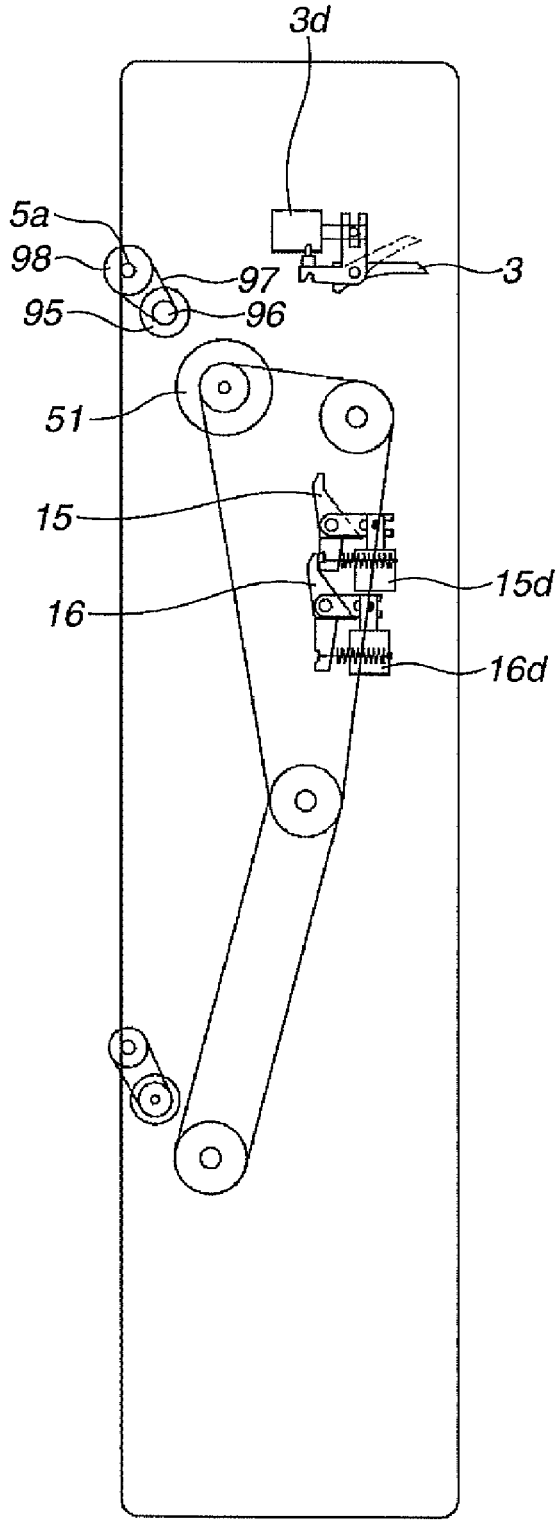
FIG. 6 illustrates a front view of an example drive portion of a conveying system in the sheet processing apparatus according to an exemplary embodiment of the present invention

Guides 11 and 12 are provided to guide the sheet P being conveyed. A conveyance roller 14 is provided opposite to a conveyance roller 13. An upper switching flapper 15 and a lower switching flapper 16 take either a position shown in a dashed line or a solid line depending on the state of an upper switching solenoid 15*d* and a lower switching solenoid 16*d*, respectively, as illustrated in FIG. 6. Elastic members 17*d* and 22*d* are disposed opposite to half-moon shaped semi-circular rollers 17*a* and 22*a*, respectively. The elastic members 17*d* and 22*d* are biased to the semi-circular rollers 17*a* and 22*a*, respectively.

A stapler unit 18 includes a plate-like staple and a drive motor. The stapler unit 18 pivots around a rotation shaft 18*a*. An anvil 19 guides and bends ends of a U-shaped staple when the stapler unit 18 pivots around the rotation shaft 18*a*.

Guides 20 and 21 are provided downstream of the stapler unit 18. Width alignment members 24*a* and 24*b* are configured to align sheets by pressing the sheets from both sides of the sheet (see FIG. 7). A sheet positioning member 23 (sheet storing portion) receives a leading edge of a sheet that has passed through the guides 20 and 21 and temporarily stores the sheet. The sheet positioning member 23 is movable along the guides 20 and 21 in the direction of an arrow illustrated in FIG. 5. Further, a leading edge detection sensor 33 configured to detect a leading edge of a sheet is placed on the sheet positioning member 23.

An extrusion unit 25 takes a withdrawn position below the guides 12 and 21 before the sheet folding operation is started. Folding rollers 26 and 27, serving as a folding portion, press against each other and are capable of rotating forward and backward to fold at least one sheet.

Figure 11:
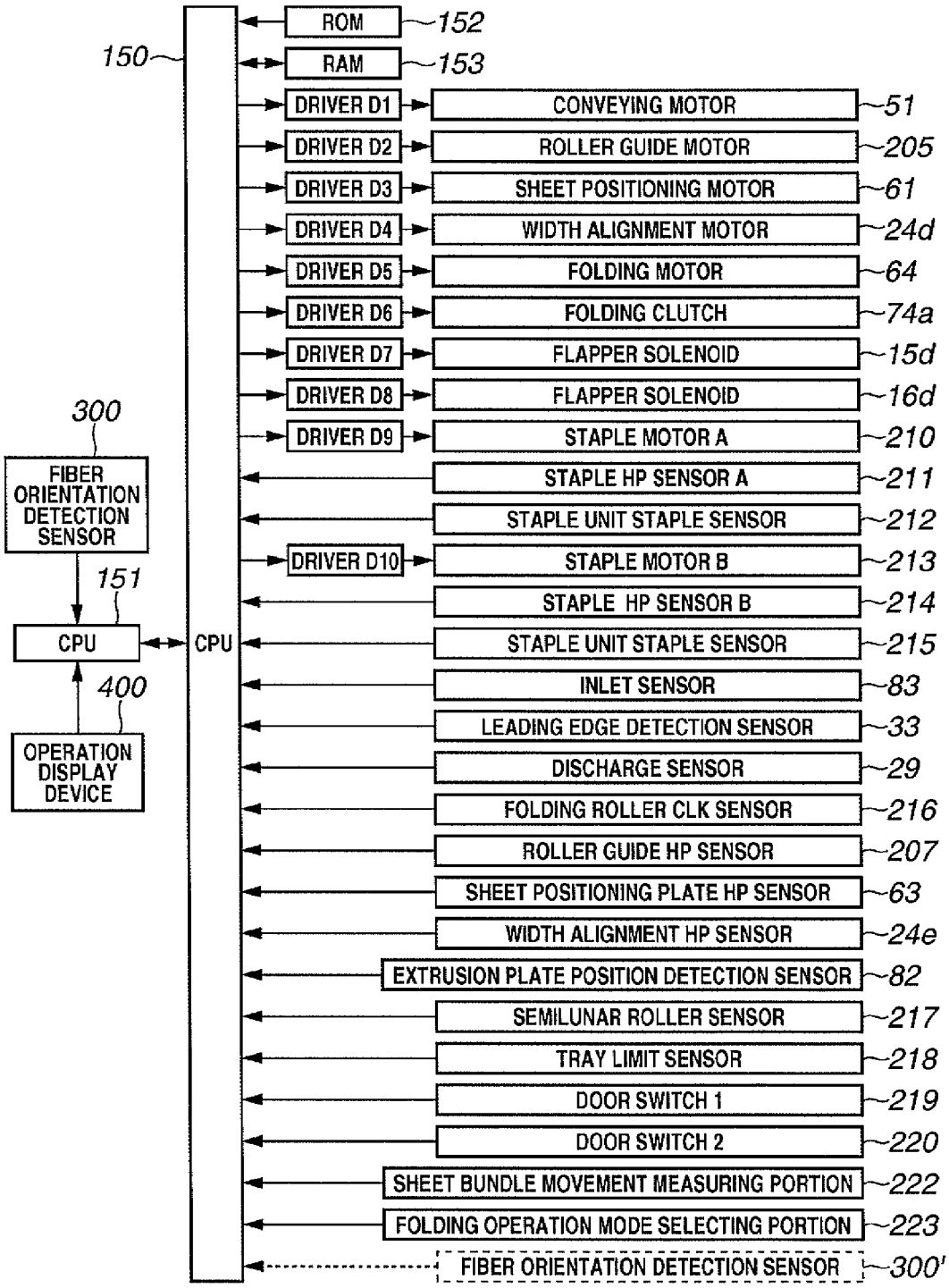
FIG. 11 is a block diagram illustrating control of the sheet processing apparatus according to an exemplary embodiment of the present invention.

The folding rollers 26 and 27 are controlled based on a signal output from a controller (see FIG. 11). According to a sheet counter CNT1 serving as a sheet counting portion, sheets are either single-folded or double-folded. Based on a signal output from a folding operation mode selecting portion 223, the folding rollers 26 and 27 are controlled so that they take either a first mode for single folding or a second mode for double folding.

Further, a movement of the sheets by the folding rollers 26 and 27 is measured by a sheet movement measuring portion 222. When the sheets are folded twice, after the sheets are conveyed in a direction opposite to the extrusion direction, the sheets are conveyed back in the extrusion direction for the second folding.

A discharge guide 28 guides a folded sheet bundle discharged by the folding rollers 26 and 27 to a nip between a folded sheet bundle discharge roller 30 and a roller 31. A discharge sensor 29 detects a leading edge and a trailing edge of a folded sheet bundle. A discharge tray 32 receives a folded sheet bundle.

Figure 7:
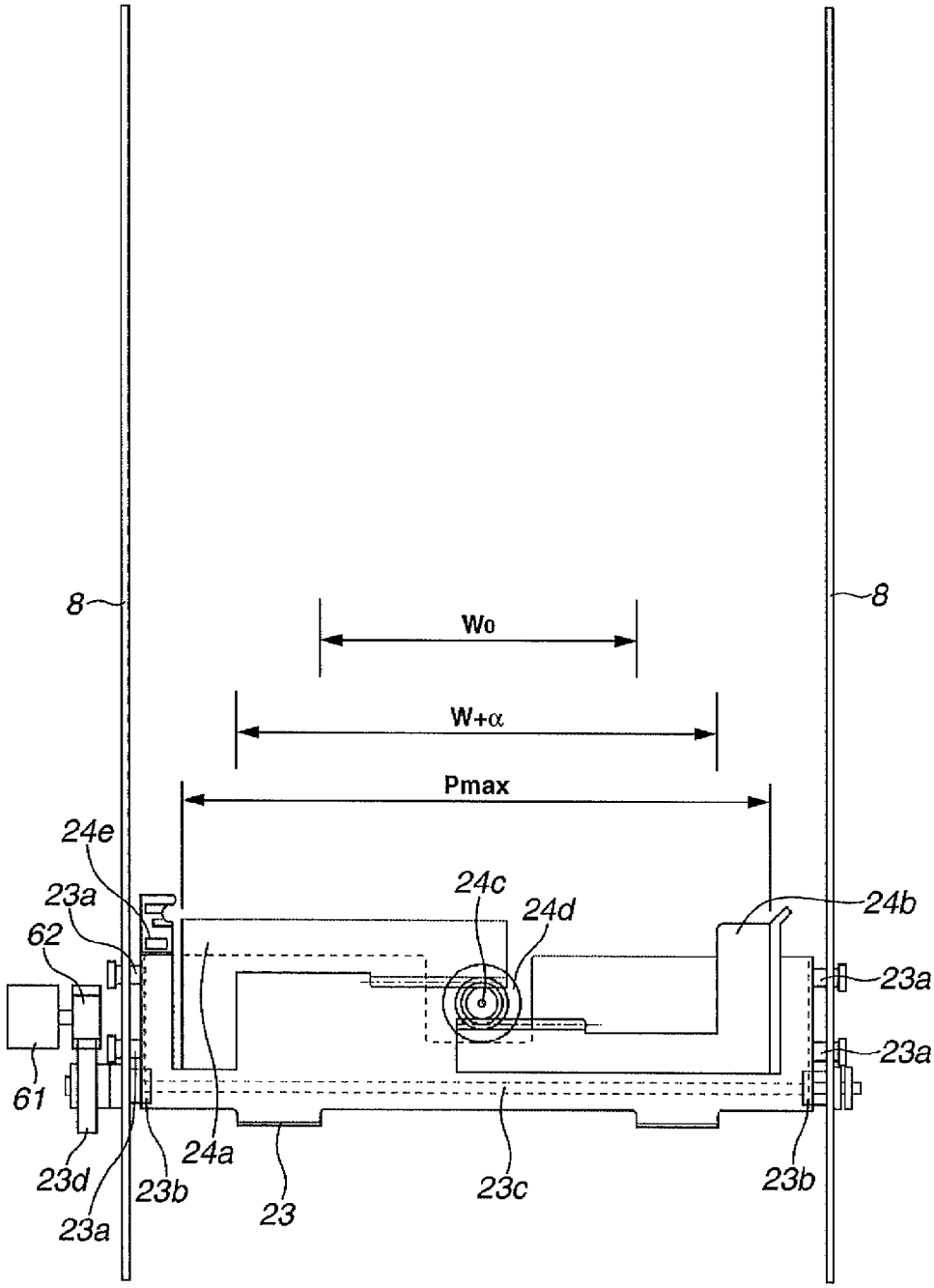
FIG. 7 illustrates a front view of an example width alignment portion and a sheet positioning member in the sheet processing apparatus according to an exemplary embodiment of the present invention

The width alignment mechanism will be described next with reference to FIG. 7. Width alignment members 24*a* and 24*b* are level with a sheet in a sheet conveying direction and include a wall perpendicular to both sides of the sheet and a rack portion in the center. A pinion gear 24*c* engages with a rack of the width alignment member 24*a* and a rack of the width alignment member 24*b*. The pinion gear 24*c* is secured to an output shaft of a width alignment motor 24*d*, which is a stepping motor. A width alignment HP sensor 24*e* is composed of a photo interrupter. The width alignment home position (HP) sensor 24*e* is arranged in such a position as to detect a flag set on the width alignment member 24*a* when the width alignment members 24*a* and 24*b* take withdrawn positions approximately 5 mm to 10 mm outward from a maximum sheet width.

An example sheet positioning drive mechanism will be described now with reference to FIGS. 5 and 7. The sheet positioning member 23 receives a leading edge of a sheet that has passed through the guides 20 and 21. The sheet positioning member 23 has a plurality of rollers 23*a* mounted rotatably on both ends of the sheet positioning member 23. The rollers 23*a* slide along a groove portion formed in a frame 8. A rack is formed on one end of the sheet positioning member 23 and another rack is formed on the other end. The racks engage with a pinion gear pair 23*b* provided on the right and on the left. A shaft 23*c*, which is located between the pinion gear pair 23*b*, transmits drive to the pinion gear pair 23*b*. A stopper gear 23*d* is secured to one end of the shaft 23*c*.

A sheet positioning motor 61 is a stepping motor. A gear 62 is secured to an output shaft of the sheet positioning motor 61. The gear 62 engages with the stopper gear 23*d*.

A flag is set on a portion of the sheet positioning member 23. A sheet positioning plate HP sensor 63 detects whether the sheet positioning member 23 is at its home position. A leading edge detection sensor 33 detects the leading edge of a conveyed sheet when the sheet reaches an end of a stopper.

Figure 8:
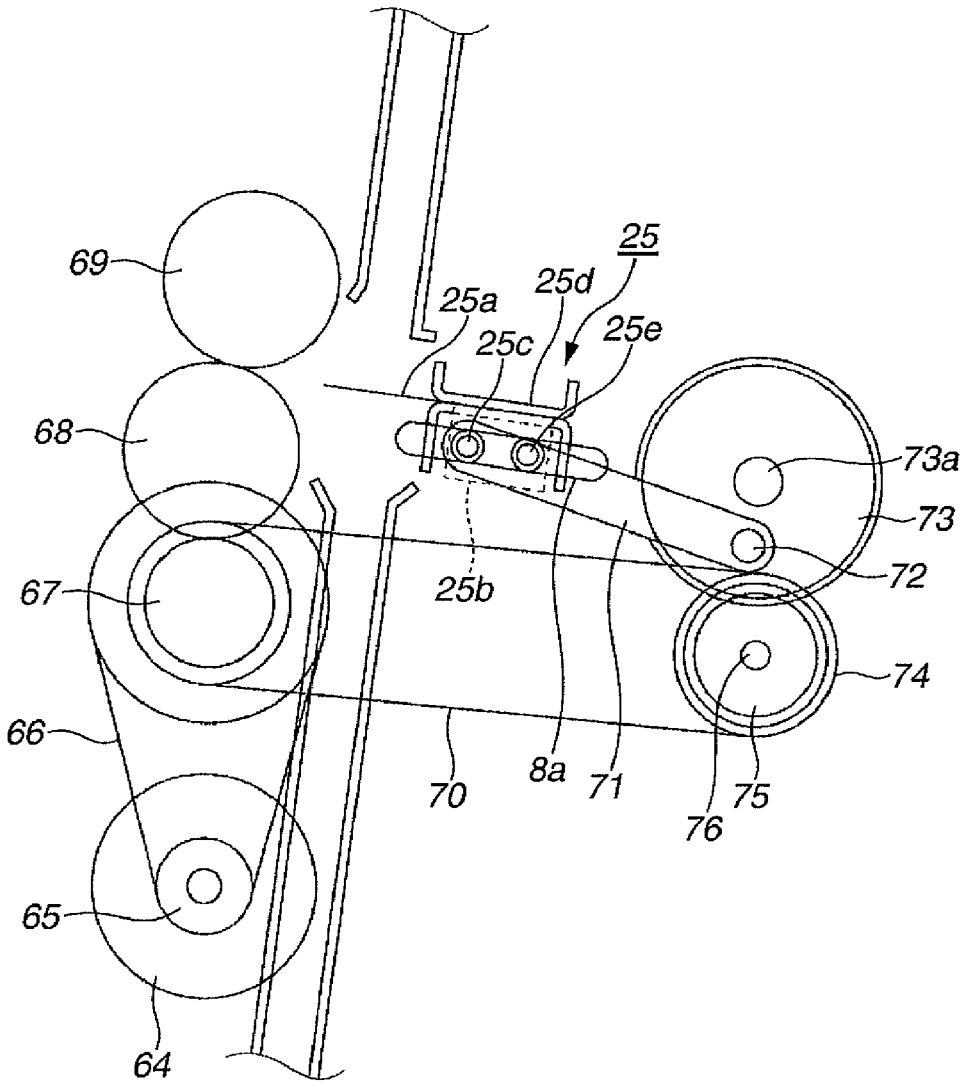
FIG. 8 illustrates a front view of an example extrusion unit portion and a folding roller portion of the sheet processing apparatus according to an exemplary embodiment of the present invention
Figure 9:
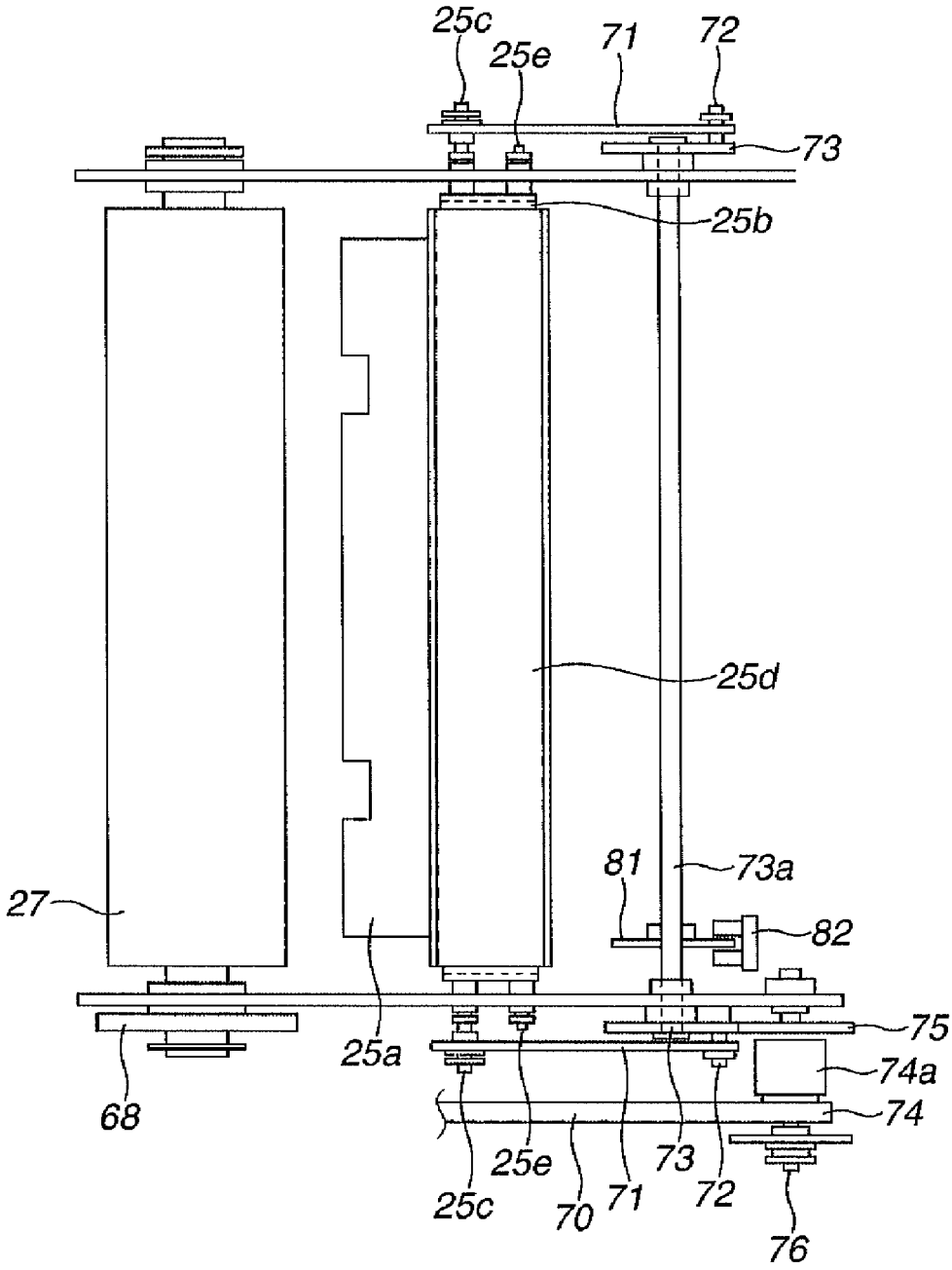
FIG. 9 illustrates a top view of an example extrusion unit portion and a folding roller portion of the sheet processing apparatus according to an exemplary embodiment of the present invention

A drive mechanism for a folding operation is described now in detail with reference to FIGS. 8 and 9. A pulley 65 is secured to an output shaft of a folding motor 64. An idler gear pulley 67 has two pulleys and a gear on the same shaft. A timing belt 66 is placed over one of the two pulleys and the pulley 65. Folding gears 68 and 69 intermesh and are secured to the folding rollers 26 and 27, respectively. One end of the folding gear 68 engages with a gear portion of the idler gear pulley 67.

An extrusion unit 25 has an extrusion plate 25*a*. The extrusion plate 25*a* is made from material such as stainless steel. Having a thickness of approximately 0.5 mm, the extrusion plate 25*a* is movable up to a nip of the folding rollers 26 and 27. The extrusion plate 25*a* is held by holders 25*d* and 25*b*. Shafts 25*c* and 25*e* are secured to the holder 25*b*. Rollers are arranged rotatably around the shafts 25*c* and 25*e*. The rollers slide along a groove portion 8*a* formed in the frame 8. A gear 73, having a shaft 72, engages with an idler gear 75. The idler gear 75 is secured to a shaft 76. A folding clutch (extrusion clutch) 74*a*, which is an electromagnetic clutch, is arranged on the shaft 76. A transmission of a rotation of a pulley 74 on the folding clutch 74*a* to the shaft 76 is controlled by an engagement or a disengagement of the folding clutch 74*a*. A timing belt 70 is placed over the pulley 74 and a pulley portion of the idler gear pulley 67. The idler gear 75, which is secured to the shaft 76, engages with the gear 73, which is secured to a shaft 73*a*. A flag 81 set on the shaft 73*a* has a notch. An extrusion plate position detection sensor 82 is arranged at a position to detect the notch of the flag 81. The extrusion plate position detection sensor 82 is arranged so that the extrusion plate 25*a* is detected at a lowest position from the sheet conveying surface of the guides 12 and 21.

A rotation of the folding motor 64 is transmitted from the pulley 65 to the idler gear pulley 67 through the timing belt 66. A rotation of the idler gear pulley 67 is transmitted to a folding gear 68 and further to a folding gear 69, and drives the folding rollers 26 and 27. On the other hand, a rotation of the idler gear pulley 67 is transmitted to the pulley 74 on the folding clutch 74*a* through the timing belt 70. By an engagement or a disengagement of the folding clutch 74*a*, the rotation of the pulley 74 is transmitted to the shaft 76. Then, the idler gear 75 rotates. By the rotation of the idler gear 75, the gear 73 rotates and the shaft 72 makes a circular motion around the shaft 73*a*. One end of a link 71 is coupled to the shaft 72 while the other end is coupled to the shaft 25*c*. Since the shaft 25*c* is secured to the extrusion unit 25 and, together with the shaft 25*e*, has a roller in the groove 8*a* of the frame 8, the shaft 25*c* makes a linear motion along the groove 8*a*. According to this linear motion, the extrusion plate 25*a* in the extrusion unit 25 can linearly move to an extruding position and back to a withdrawing position.

A drive mechanism for the stacker discharge roller 5 will be described now with reference to FIG. 6. A shaft 5*a* which secures the stacker discharge roller 5 is arranged in an upper portion of the finisher 2. A pulley 98 is secured to the shaft 5*a*. A pulley 96 is secured to an output shaft of a stacker discharge motor 95.

A timing belt 97 is placed over the pulleys 96 and 98. A rotation of the stacker discharge motor 95 is transmitted from the pulley 96 to the pulley 98 through the timing belt 97, and further transmitted to the stacker discharge roller 5 through the shaft 5*a* to drive the stacker discharge roller 5. The stacker discharge motor 95 is a stepping motor. The peripheral speed of the stacker discharge roller 5 exceeds that of the discharge roller pair 104 of the image forming apparatus main body 1. A conveying force of the discharge roller pair 104 is set to be greater than that of the stacker discharge roller 5 and the stacker discharge roller 6. Accordingly, when a sheet is conveyed between the discharge roller pair 104, the sheet slips between the stacker discharge roller 5 and the stacker discharge roller 6. When the sheet passes the discharge roller pair 104, the sheet is conveyed by a conveying force generated by the stacker discharge roller 5 and the stacker discharge roller 6.

FIG. 11 is a block diagram illustrating control of the sheet processing apparatus. A central processing unit (CPU) 150 is a control device serving as a controller included in the finisher 2. Input and output operations of the finisher 2 are controlled by the CPU 150.

The CPU 150 receives outputs from various devices. Such devices include: an inlet sensor 83 configured to detect a sheet approaching the finisher 2 after the sheet is discharged from the image forming apparatus 1; the leading edge detection sensor 33 configured to detect a sheet that has reached a predetermined location of the finisher 2; the discharge sensor 29 configured to detect a sheet discharged on the discharge tray 32; a folding roller CLK sensor 216 configured to detect a speed of the folding rollers 26 and 27; a roller guide HP sensor 207 configured to detect a home position of a roller guide 201; a sheet positioning plate HP sensor 63 configured to detect a home position of the sheet positioning member 23; the width alignment HP sensor 24*e* configured to detect a home position of the width alignment members configured to align a sheet; an extrusion plate position detection sensor 82 configured to detect a position of the extrusion plate 25*a*; a semi-circular roller sensor 217 configured to detect a rotation position of the semi-circular rollers 17*a* and 22*a*; a tray limit sensor 218 configured to detect whether sheets discharged on a tray have reached to a maximum; a door switch 219 configured to detect whether a door for jam processing is open; a door switch 220 configured to detect whether a door which is opened when an operator loads a staple is open; a staple unit staple sensor 212 configured to detect whether a staple is available in a staple unit; a staple HP sensor (A) 211 configured to detect a waiting position of a staple portion; a staple unit staple sensor 215 configured to detect whether a staple is available in a staple unit; and a staple HP sensor (B) 214 configured to detect a waiting position of a staple portion.

Further, the CPU 150 receives outputs from the sheet movement measuring portion 222 configured to measure a movement of a sheet that has moved from the sheet positioning member 23, and the folding operation mode selecting portion 223 configured to select a folding operation for the sheet. The folding operation mode selecting portion 223 is configured to change a folding operation mode (single folding mode or double folding mode) based on fiber orientation information and sheet information.

The CPU 150 outputs instructions to various devices. Such devices include: a conveying motor 51 configured to convey a sheet in the finisher 2 through a driver D1; a roller guide motor 205 configured to drive a roller guide used for guiding a sheet in the finisher 2 from the folding rollers 26 and 27 through a driver D2; the sheet positioning motor 61 configured to keep a sheet in the finisher 2 at a designated position through a driver D3; a width alignment motor 24*d* configured to align a sheet in the finisher 2 through a driver D4; a folding motor 64 configured to fold a sheet in the finisher 2 through a driver D5, the folding clutch 74*a* configured to operate the extrusion plate 25*a* through a driver D6; the upper switching solenoid 15*d* configured to drive the upper switching flapper 15 configured to change a sheet path in the finisher 2 through a driver D7; the lower switching solenoid 16*d* configured to drive the lower switching flapper 16 to change a sheet path in the finisher 2 through a driver D8; a staple motor (A) 210 configured to drive the stapler unit 18 configured to bind sheets through a driver D9; and, a staple motor (B) 213 configured to drive the stapler unit 18 configured to bind sheets through a driver D10.

Procedures to be performed by the CPU 150 are stored in advance in a read-only memory (ROM) 152. A random access memory (RAM) 153 stores operation data of the CPU 150 and also various data such as control data received from a control device 151 (hereinafter, referred to as a CPU 151) of the image forming apparatus main body 1. It is to be noted that although the CPU 150 as a controller is arranged in the finisher 2 to control the finisher 2 according to an exemplary embodiment of the present invention, the CPU 150 can also be arranged in the image forming apparatus main body 1 together with the CPU 151.

An example configuration of a folding operation mode selecting portion illustrated in FIG. 11 will be described below. When an operator sets a document bundle on the document feeder 101 illustrated in FIG. 1 and presses a start button on the operation display device 400, a document feeding is started and a document image is scanned at the reading portion 102. During the scanning process, image information, sheet size, and number of sheets are determined based on information sent from each sensor serving as a sheet information providing portion and are stored in the CPU 151 in the image forming apparatus main body 1. The CPU 151 determines whether the sheet is either fed from the cassette 914, 915 or from the manual feed portion 925. The operator inputs grammage of the sheets set in the cassettes 914 and 915 and the manual feed portion 925 prior to the scanning operation using the operation display device 400 as a sheet information providing portion. Such information is stored in the CPU 151. Accordingly, when the paper feed stage from which the sheet is delivered is determined, sheet information, such as information on number of sheets, grammage, and size, is sent to the CPU 150.

Figure 4:
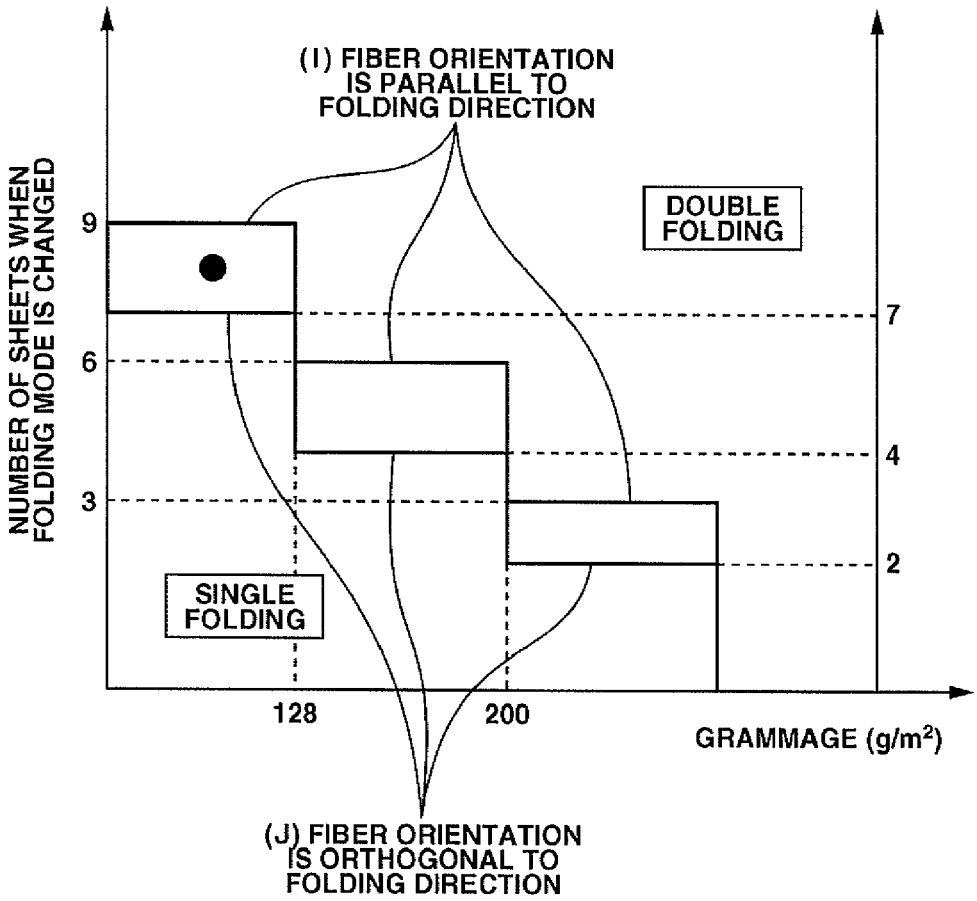
FIG. 4 is a table illustrating a selecting operation of a folding operation mode selecting portion according to an exemplary embodiment of the present invention.

When the CPU 151 outputs a paper feed signal, paper feeding from a corresponding paper-feed stage starts. When the sheet passes through the fiber orientation detection sensor 300 or the fiber orientation detection sensor 300' (a portion indicated by a broken line in FIG. 11) in the finisher 2, fiber orientation information of the sheet is added to the above-described sheet information. This data is sent from the CPU 151 in the image forming apparatus main body 1 to the CPU 150 in the finisher 2. In the case of the fiber orientation detection sensor 300', the data is directly sent to the CPU 150. The CPU 150 checks the received sheet information including number of sheets, grammage, and sheet fiber orientation with a table illustrated in FIG. 4. The table illustrated in FIG. 4 is based on a combination of the sheet fiber orientation, a number of sheets, and grammage. The folding operation mode, i.e., the single folding mode or the double folding mode, is then selected and determined by the folding operation mode selecting portion 223 (FIG. 11).

The table according to which the folding operation mode selecting portion 223 selects the folding operation mode will be described below with reference to FIG. 4. According to an exemplary embodiment of the present invention, a folding direction of a sheet is determined based on a sheet conveying direction. In other words, a direction orthogonal to the sheet conveying direction will be the folding direction since the folding operation is performed while a sheet is folded and conveyed by the folding rollers 26 and 27 in the sheet conveying portion. Accordingly, the sheet fiber orientation according to an exemplary embodiment of the present invention is described as a fiber orientation relative to the sheet conveying direction.

FIG. 4 is a diagram illustrating a reference for switching the folding operation mode based on number of sheets, sheet grammage, and sheet fiber orientation. A line I represents a reference number of sheets used for switching the folding operation mode when the sheet fiber orientation is orthogonal to the sheet conveying direction. In this case, since the sheet fiber orientation is parallel to the folding direction, the sheet is easily folded. On the other hand, a line J represents a reference number of sheets used for switching the folding operation mode when the sheet fiber orientation is parallel to the sheet conveying direction. In this case, since the fiber orientation is orthogonal to the folding direction, folding is not easy compared to when the fiber orientation is orthogonal to the sheet conveying direction.

For example, if the number of sheets is 8, sheet grammage is 80 g/m$^2$ (point • in FIG. 4), and the sheet fiber orientation is orthogonal to the folding direction, a switching boundary represented by the line J is selected. This means that double folding mode will be selected. If the number of sheets is 8, sheet grammage is 80 g/m$^2$, and the sheet fiber orientation is parallel to the folding direction, then a switching boundary represented by the line I is selected. This means that single folding mode will be selected. It is to be noted that the number of times of folding is not limited to one or two. In order to obtain a quality binding appearance, a folding operation needs to be performed a predetermined number of times. In a case where the sheet fiber orientation is orthogonal to the folding direction, a folding operation is performed for a larger number of times compared to a case where the sheet fiber orientation is parallel to the folding direction.

According to an exemplary embodiment of the present invention, a folding mode is selected from either the single folding mode or the double folding mode. However, the present invention is also effective under other folding conditions. For example, a similar effect can be attained by a sheet processing apparatus configured to change a folding pressure applied to a sheet between the folding rollers 26 and 27 depending on sheet fiber orientation, number of sheets, and sheet grammage.

Figure 2:
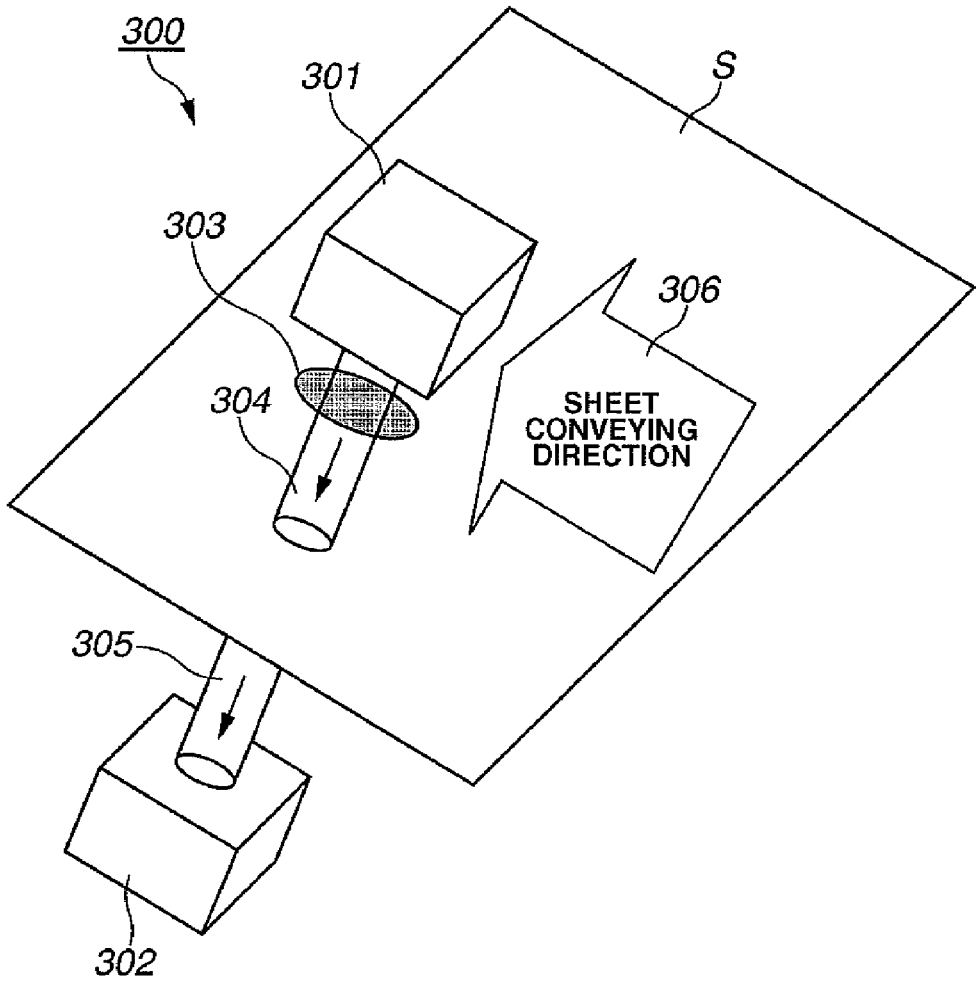
FIG. 2 illustrates an example apparatus configured to detect a fiber orientation of a sheet according to an exemplary embodiment of the present invention.
Figure 3:
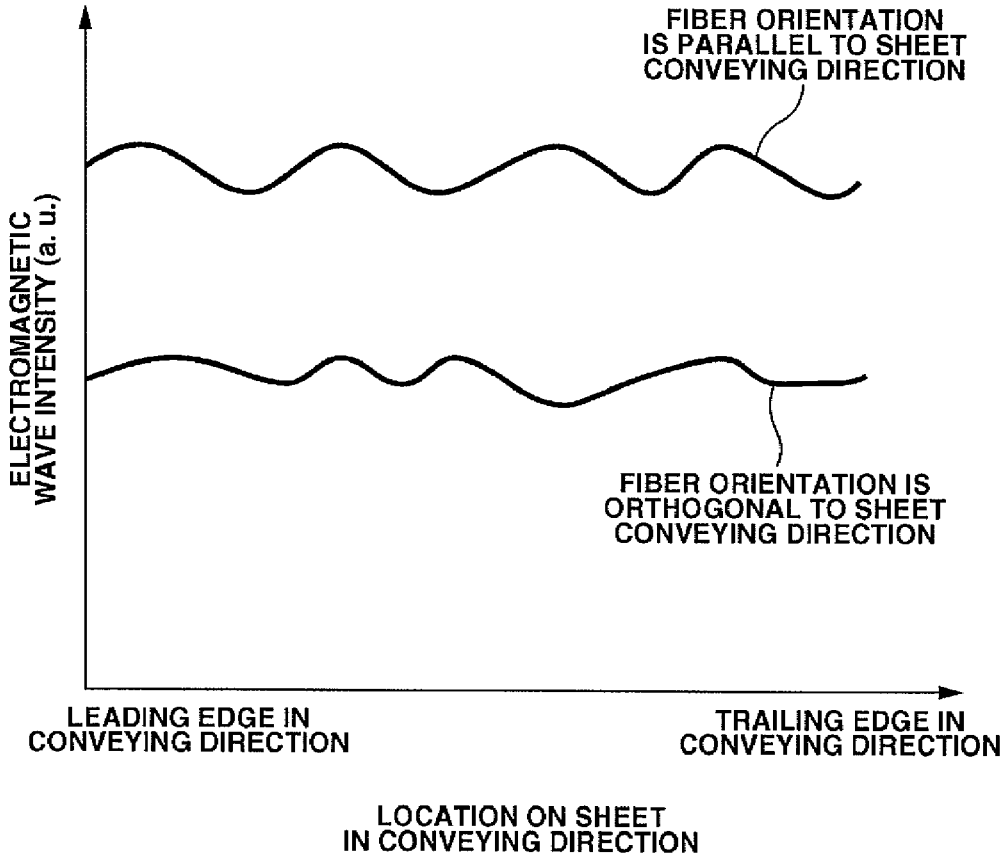
FIG. 3 illustrates an analytical curve for detection using a terahertz wave.

Referring now to FIGS. 1 to 3, an example method for acquiring the fiber orientation information will be described. The fiber orientation detection sensor 300 emits an electromagnetic wave to a sheet. Based on a transmitted electromagnetic wave and a reflected electromagnetic wave, the fiber orientation detection sensor 300 detects a direction of fibers used in the sheet to determine the fiber orientation of the sheet.

The fiber orientation detection sensor 300 is a sensor capable of detecting a high-frequency electromagnetic wave that ranges from 30 GHz to 30 THz (terahertz wave: hereinafter referred to as a THz wave). By emitting a THz wave to a sheet that is being conveyed and detecting either a transmitted electromagnetic wave, which is transmitted through the sheet or a reflected electromagnetic wave, which is reflected by the sheet, the fiber orientation detection sensor 300 detects the fiber orientation without contacting the sheet. Since the fiber orientation gives polarization mode dispersion to the THz wave, the fiber orientation of a sheet can be determined based on an intensity of at least one of a transmitted electromagnetic wave or a reflected electromagnetic wave, which is polarized as a polarized wave.

FIG. 2 illustrates a THz wave light source 301 serving as a light emitting unit, a THz wave detector 302 serving as a THz wave detecting unit, a polarizer 303, an emitted electromagnetic wave 304, and a transmitted electromagnetic wave 305. When the electromagnetic wave 304, which is a high-frequency electromagnetic wave having a frequency band ranging from 30 GHz through 30 THz, is emitted from the THz wave light source 301, the emitted electromagnetic wave 304 is polarized by the polarizer 303 into a polarized wave that is parallel to a sheet conveying direction 306. The electromagnetic wave 305, which is transmitted through a sheet S that is being conveyed, reaches the THz wave detector 302, which is arranged opposite to the THz wave light source 301. Consequently, as illustrated in FIG. 3, an intensity of the electromagnetic wave corresponding to the fiber orientation is detected along the sheet conveying direction.

Since the emitted electromagnetic wave 304 is polarized into a polarized wave parallel to the conveying direction 306, when the fiber orientation is parallel to the conveying direction, an intensity of the transmitted electromagnetic wave becomes high, whereas when the fiber orientation is orthogonal to the conveying direction, an intensity of the transmitted electromagnetic wave becomes low, as illustrated in FIG. 3. If the fiber orientation is at an angle with the conveying direction, in other words, if a change in signal variation is small, an average fiber orientation can be determined by acquiring a mean value of an integral of a signal from a predetermined area.

According to an exemplary embodiment of the present invention, the fiber orientation detection sensor 300 is arranged upstream of the image forming portion 9003 of the image forming apparatus main body 1, as illustrated in FIG. 1. However, as illustrated in FIG. 5, so long as the fiber orientation detection sensor 300' is arranged on a sheet conveying path between the sheet feeding portion 9002 and a bookbinding portion of the finisher 2, a similar effect can be produced even when it is set in the finisher 2. In addition, there is a case where fiber orientation information is printed on a package of cut sheets. The operator can input such information using the operation display device 400 of the image forming apparatus main body 1.

An example control operation for the sheet processing apparatus according to an exemplary embodiment of the present invention will be described below with reference to FIGS. 12 through 15.

Figure 12:
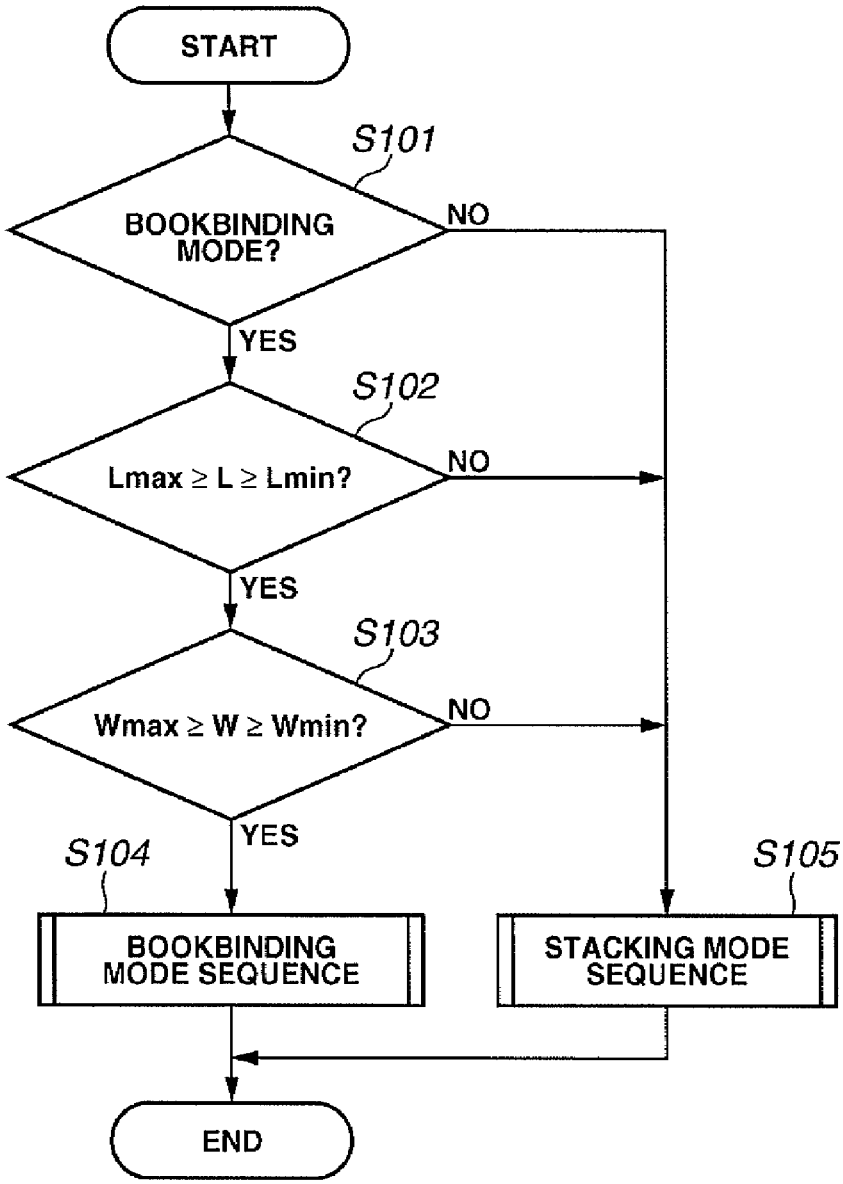
FIG. 12 illustrates an example main flowchart of the sheet processing apparatus in a bookbinding mode according to an exemplary embodiment of the present invention.

FIG. 12 illustrates a main routine of the sheet processing apparatus. First, the CPU 150 receives operation mode information, i.e., a bookbinding mode or a stacking mode, from the image forming apparatus main body 1, to which the finisher 2 is connected. Further, the CPU 150 receives size information, such as sheet length L and sheet width W, of sheets to be discharged from the image forming apparatus main body 1, and information on the number of sheets N and information on the number of sets M regarding sheets to be discharged from the image forming apparatus main body 1. When the finisher 2 receives a start signal, the finisher 2 starts to operate.

In step S101, the CPU 150 confirms the operation mode information. If the operation mode is not the bookbinding mode (NO in step S101), then the process proceeds to step S105, where a stacking mode sequence starts. If the operation mode is the bookbinding mode (YES in step S101), then in steps S102 and S103, the CPU 150 confirms whether the sheet has a length L and a width W required for bookbinding. If the sheet is determined not to satisfy the required size (NO in steps S102 and S103), the process proceeds to step S105. If the sheet is determined to satisfy the required size (YES in steps S102 and S103), the process proceeds to step S104, where a bookbinding mode sequence starts.

Figure 13:
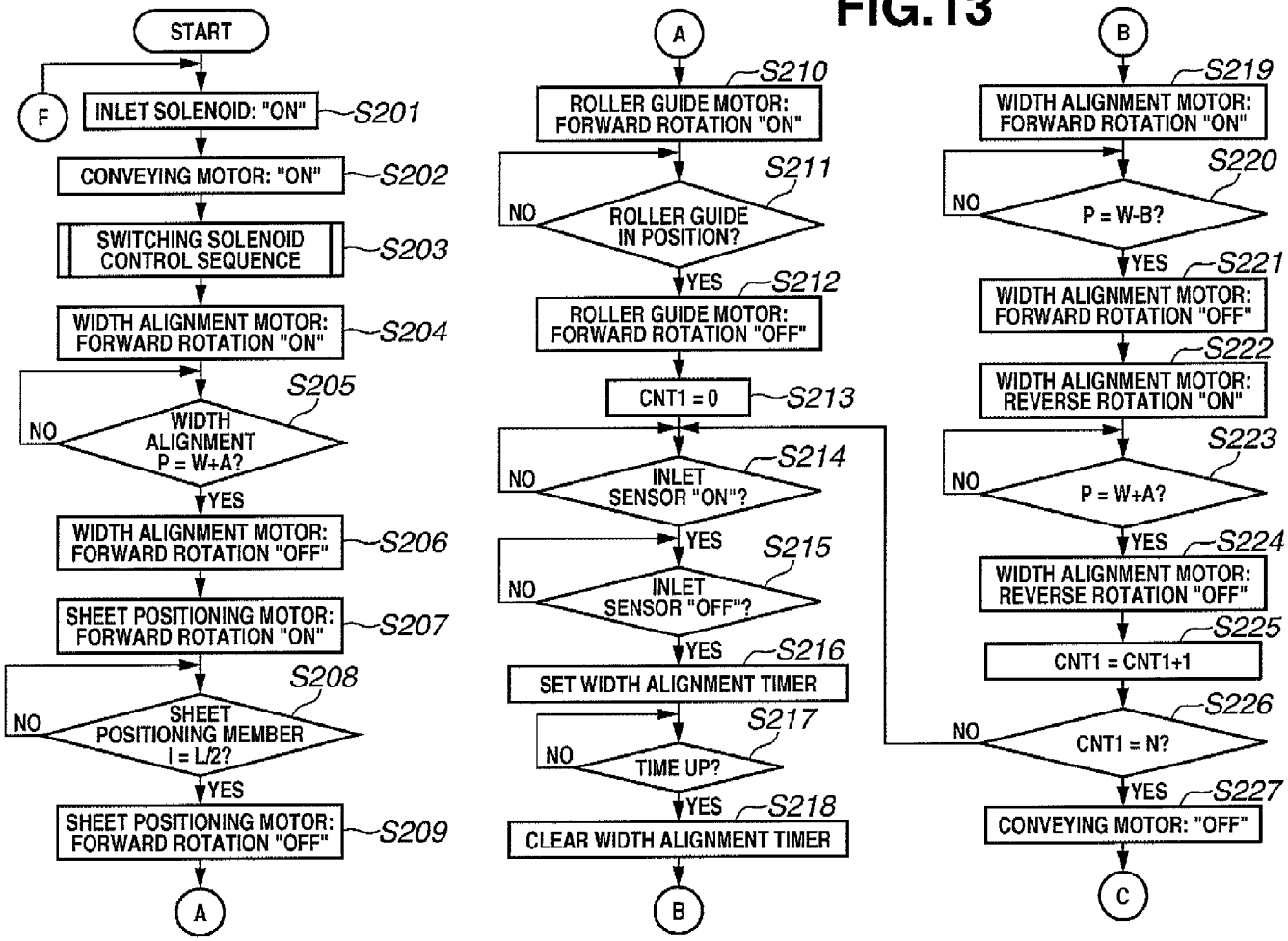
FIG. 13 illustrates a flowchart of an example basic operation of the sheet processing apparatus according to an exemplary embodiment of the present invention.
Figure 14:
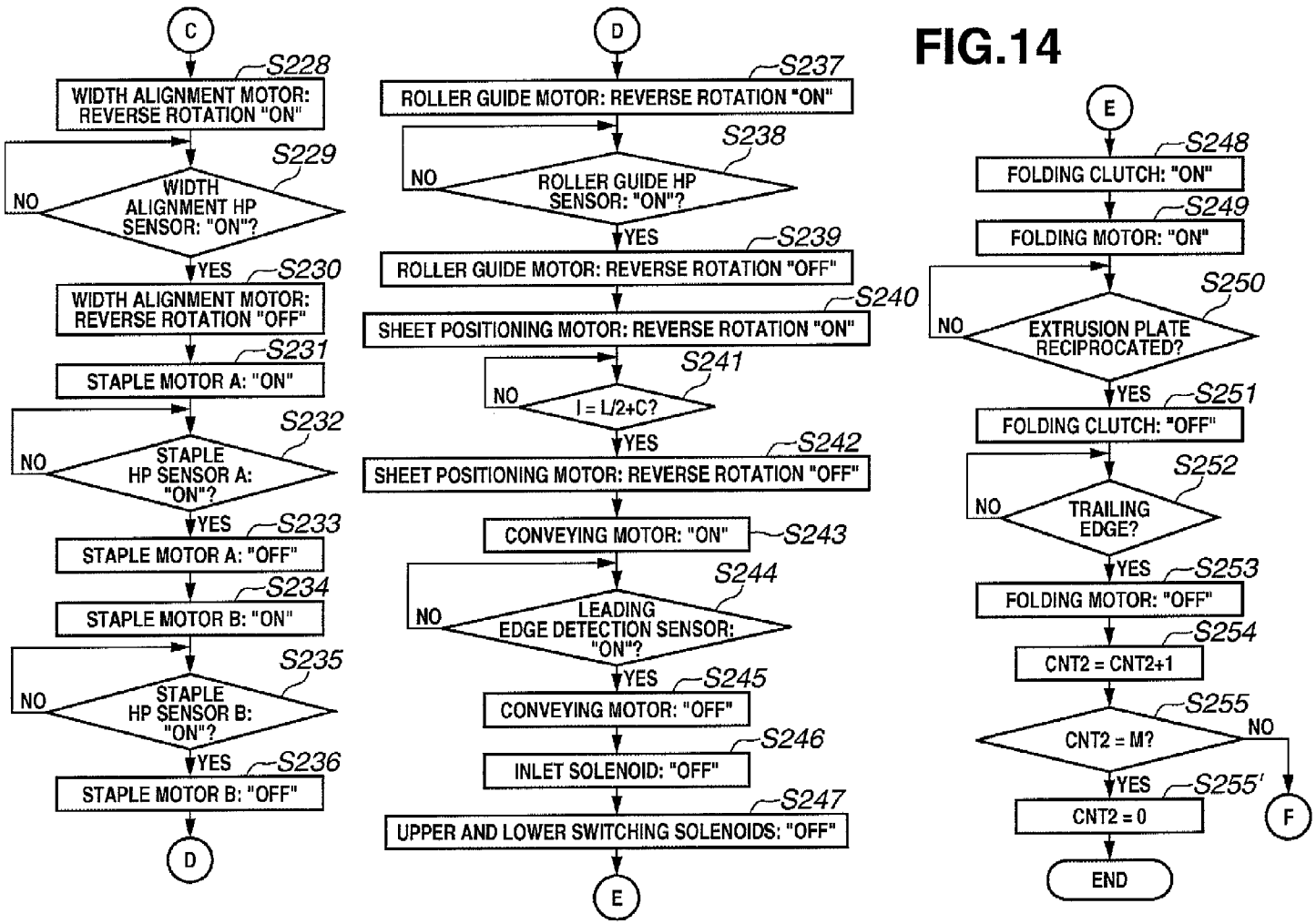
FIG. 14 illustrates a flowchart of an example basic operation of the sheet processing apparatus according to an exemplary embodiment of the present invention.

A basic bookbinding mode sequence will be described now with reference to FIGS. 13 and 14. If the sheet has a size that allows binding, then in step S201, the CPU 150 activates the inlet solenoid 3*d* to open a path to the bookbinding mode. In step S202, the CPU 150 activates the conveying motor 51 to drive the conveyance rollers 13 and 14 and the semi-circular rollers 17*a* and 22*a* to convey the sheet.

In step S203, the CPU 150 controls the upper switching solenoid 15*d* and the lower switching solenoid 16*d*. In step S204, the CPU 150 directs the width alignment motor 24*d* to make a forward rotation so that a distance P between the width alignment members 24*a* and 24*b* becomes equal to a sheet width W plus "A", which is a distance between the sheet and the width alignment member 24*a* or 24*b* and is generally about 10 mm. In step S205, if P=W+A (YES in step S205), then in step S206, the CPU 150 instructs the width alignment motor 24*d* to stop rotating.

In step S207, the CPU 150 directs the sheet positioning motor 61 to make a forward rotation. In step S208, if the sheet positioning member 23 reaches a position downstream of a staple point 19*a* of the stapler unit 18 where 1=L/2 (YES in step S208), then in step S209, the CPU 150 stops the forward rotation of the sheet positioning motor 61. In steps S210 and S211, the CPU 150 directs the roller guide motor 205 to make a forward rotation so that the roller guide 201 moves to a predetermined position where a conveyed sheet does not contact the folding rollers 26 and 27.

If the roller guide 201 moves from the home position to the predetermined position (YES in step S211), then the process proceeds to step S212. In step S212, the CPU 150 stops the forward rotation of the roller guide motor 205. Then, in step S213, the CPU 150 sets a sheet counter CNT1 to "0", and in step S214, the CPU 150 confirms whether a signal from the inlet sensor 83 is turned on. When the CPU 150 receives a signal indicating that the inlet sensor 83 is turned off in step S215 (YES in step S215), then in step S216, the CPU 150 sets a width alignment timer so that the sheet is aligned at the time the leading edge of the sheet contacts the sheet positioning member 23, i.e., after a period of time t1 from turning-off of the inlet sensor 83, based on the sheet size information. In step S217, the CPU 150 waits until the width alignment timer reaches a predetermined time. When a predetermined time is reached (YES in step S217), then in step S218, the CPU 150 clears the width alignment timer.

In step S219, the CPU 150 directs the width alignment motor 24*d* to make a forward rotation to move the width alignment members 24*a* and 24*b* up to a position where P=W−B ("B" is an amount of distance which the width alignment members 24*a* and 24*b* push the sheet and is generally about 2 mm). In step S220, if P=W−B, then in step S221, the CPU 150 stops the forward rotation of the width alignment motor 24*d*.

In step S222, in order to place the width alignment members 24*a* and 24*b* in position for the next sheet, the CPU 150 directs the width alignment motor 24*d* to make a reverse rotation to move the width alignment members 24*a* and 24*b* up to a position where P=W+B. When P=W+A in step S223, then in step S224, the CPU 150 stops the reverse rotation of the width alignment motor 24*d*.

The above-described operations from steps S219 through S224 are performed during a short period of time when the semi-circular rollers 17*a* and 22*a* does not contact the elastic members 17*d* and 22*d* on the opposite side. In step S225, the CPU 150 adds "1" to the number of sheets counted by the sheet counter CNT1 until the count reaches a predetermined number N. When the number of sheets reaches N in step S226, the CPU 150 stops the conveying motor 51 in step S227 to stop conveying sheets.

Then, an operation for returning the width alignment members 24*a* and 24*b* to their home positions is started. In step S228, the CPU 150 directs the width alignment motor 24*d* to make a reverse rotation. The width alignment motor 24*d* continues to rotate in a reverse direction until the width alignment HP sensor 24*e* detects that the width alignment members 24*a* and 24*b* return to their home positions in step S229. In step S230, the CPU 150 stops the width alignment motor 24*d* from rotating. In steps S231 through S236, a plurality of sheets are stapled in two positions. In step S231, the CPU 150 activates the staple motor (A) 210. The staple motor (A) 210 continues to rotate until the staple HP sensor (A) 211 detects that the stapler unit 18 returns to its home position in step S232. In step S233, the CPU 150 stops the staple motor (A) 210 from rotating. In step S234, the CPU 150 activates the staple motor (B) 213. The staple motor (B) 213 continues to rotate until the staple HP sensor (B) 214 detects that the stapler unit 18 returns to its home position in step S235. In step S236, the CPU 150 stops the staple motor (B) 213 from rotating.

In step S237, in order to move the roller guide 201 to its home position to prepare for a folding operation, the CPU 150 directs the roller guide motor 205 to make a reverse rotation. The roller guide motor 205 continues to rotate in a reverse direction until the roller guide HP sensor 207 detects the roller guide 201 at its home position in step S238. In step S239, the CPU 150 stops the reverse rotation of the roller guide motor 205. Then, in step S240, the CPU 150 directs the sheet positioning motor 61 to make a reverse rotation. This rotation is continued until the sheet positioning member 23 is located at a predetermined position downstream of the stapler position 19*a* where 1=(L/2)+C ("C" is a distance between the stapler position 19*a* and the folding position) (step S241). If in step S241 the sheet positioning member 23 determines that the sheet positioning member 23 has moved to the predetermined position, then in step S242, the CPU 150 stops the reverse rotation of the sheet positioning motor 61.

In step S243, the CPU 150 starts and continues to drive the conveying motor 51 until the sheets contact the sheet positioning member 23. In step S244, the leading edge detection sensor 33 determines whether the sheets have contacted the sheet positioning member 23. In step S245, the CPU 150 stops the conveying motor 51. In step S246, the CPU 150 turns off the inlet solenoid 3*d*. In step S247, the CPU 150 turns off the upper switching solenoid 15*d* and the lower switching solenoid 16*d*.

In step S248, the CPU 150 activates the folding clutch 74*a*, and in step S249, the CPU 150 activates the folding motor 64. By an engagement of the folding clutch 74*a*, the extrusion plate 25*a* starts to extrude and guides the sheets to the folding rollers 26 and 27.

In step S250, the CPU 150 continues to activate the folding clutch 74*a* until the extrusion plate position detection sensor 82 determines that the extrusion plate 25 has reciprocated once. If the extrusion plate position detection sensor 82 determines that the extrusion plate 25*a* has reciprocated once, then in step S251, the CPU 150 turns off the folding clutch 74*a*.

In step S252, the CPU 150 turns on the folding motor 64 until the discharge sensor 29 detects the trailing edge of the folded sheet bundle. If the discharge sensor 29 detects the trailing edge in step S252, then in step S253, the CPU 150 stops the folding motor 64. In step S254, the CPU 150 adds "1" to the count of the sheet counter CNT2. If the count of the sheet counter CNT2 is less than the predetermined number M in step S255, the process returns to step S201. If the sheet counter CNT2 reaches the predetermined number M (YES in step S255), then in step S255', the CPU 150 clears the sheet counter CNT2 and the process ends.

Figure 10:
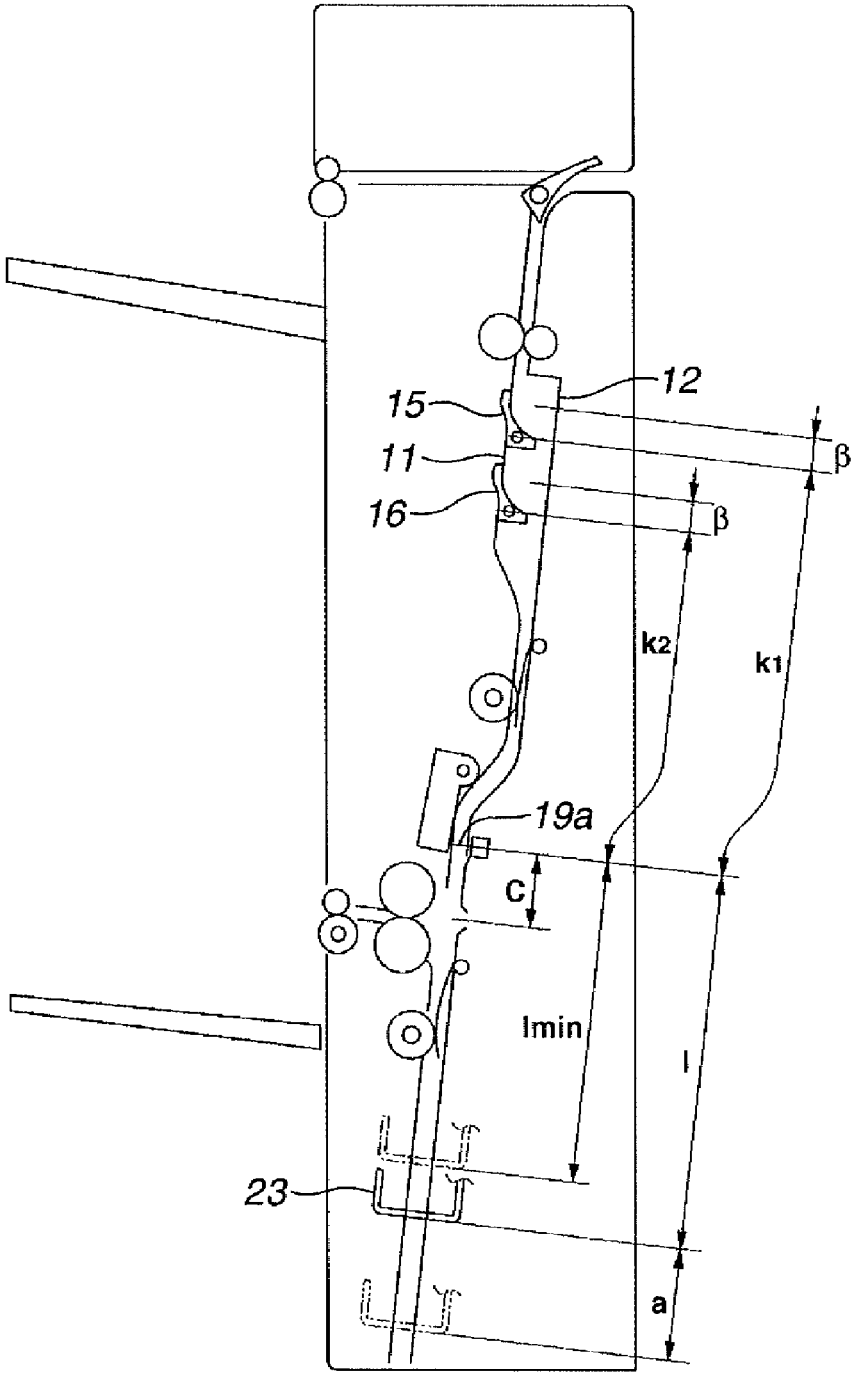
FIG. 10 is a dimensional drawing illustrating an example sheet positioning portion of the sheet processing apparatus according to an exemplary embodiment of the present invention.
Figure 15:
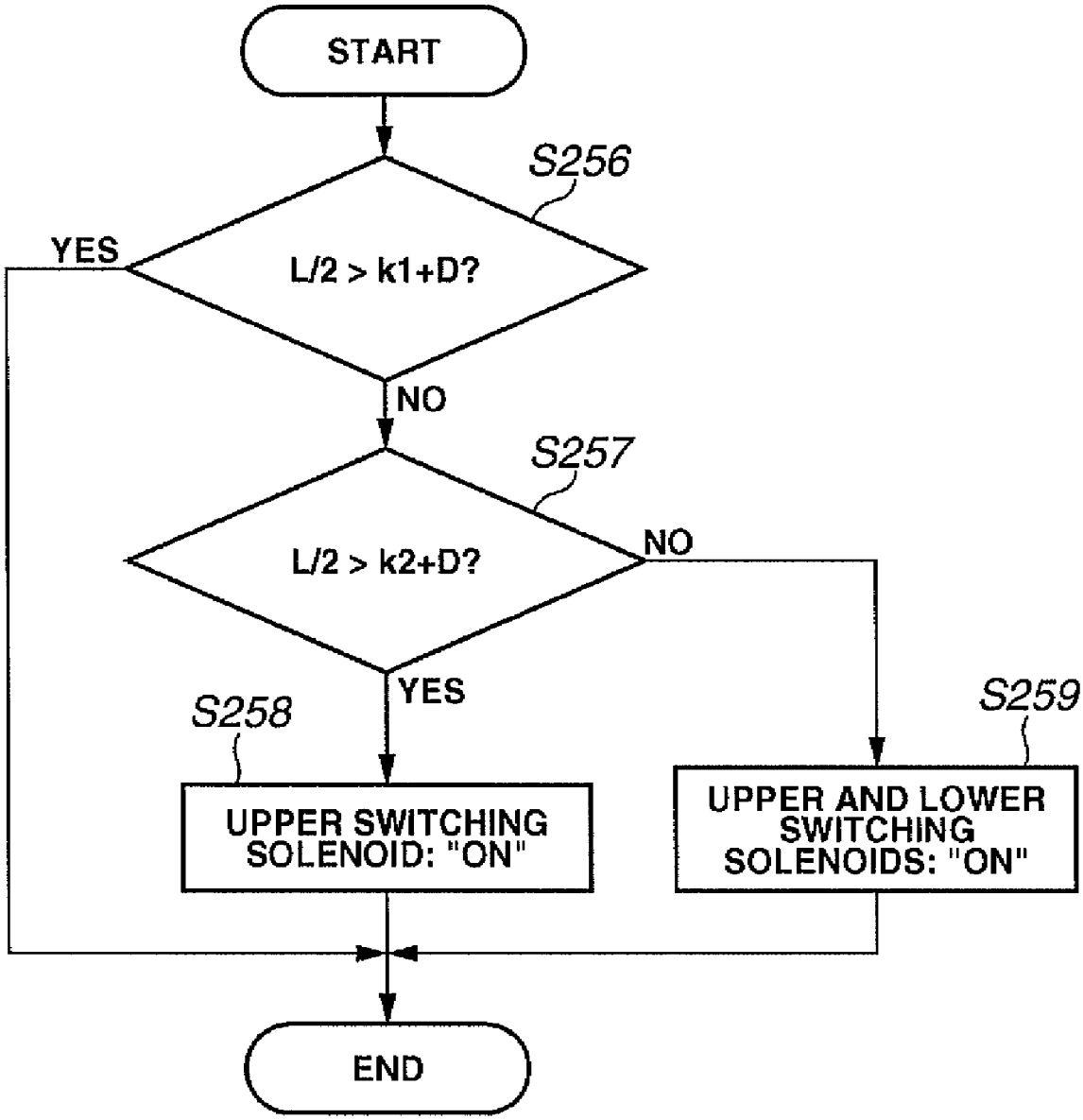
FIG. 15 is a flowchart illustrating example control of a switching solenoid according to an exemplary embodiment of the present invention.

An example control operation for the switching solenoids 15*d* and 16*d* will be described next with reference to FIG. 15. In step S256, if half the sheet length L (L/2) is greater than a sum (k1+D) of a length k1 which is the length between the staple point 19*a* and the upper switching flapper 15 along the guides 11 and 12 (see FIG. 10) and a constant D (YES in step S256), then the process ends with the upper switching solenoid 15*d* and the lower switching solenoid 16*d* kept off. The constant D represents a position of a trailing edge of a stacked sheet when the sheet positioning member 23 is in an appropriate position. The constant D is a length required in stacking a sheet on top of the stacked sheets.

If it is determined in step S256 that L/2 is equal to or less than (k1+D) (NO in step S256), then the process proceeds to step S257. In step S257, the CPU 150 determines whether L/2 is greater than a sum (k2+D) of a length k2 and the constant D. The length k2 is a length between the staple point 19*a* and the lower switching flapper 16 along the guides 11 and 12. The constant D is a length required in stacking a sheet on top of the stacked sheets.

If it is determined in step S257 that L/2 is greater than (k2+D) (YES in step S257), then in step S258, the CPU 150 activates the upper switching solenoid 15*d* to guide the sheet.

If it is determined in step S257 that L/2 is equal to or less than (k2+D) (NO in step S257), then in step S259, the CPU 150 activates the upper switching solenoid 15*d* and the lower switching solenoid 16*d* to stack the sheet along the guide 11.

Figure 16:
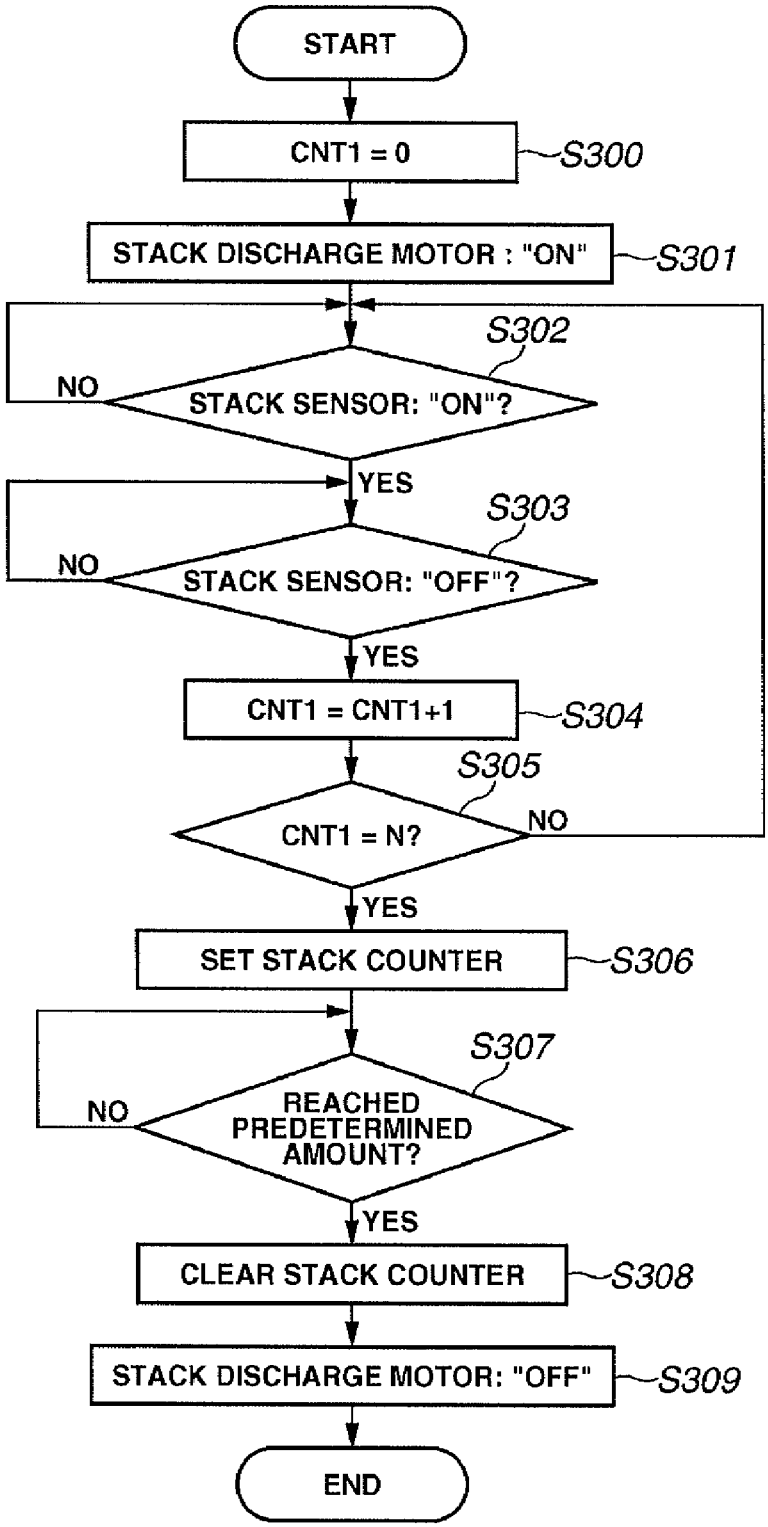
FIG. 16 is a flowchart illustrating an example operation of the sheet processing apparatus in a stacking mode according to an exemplary embodiment of the present invention.

An example stacking mode will be described next in detail with reference to FIG. 16. In step S300, the CPU 150 sets the sheet counter CNT1 to "0". Then, in step S301, the CPU 150 activates the stacker discharge motor 95 to rotate the stacker discharge roller 5.

In step S302, the CPU 150 confirms whether a stack sensor 84 is turned on. If the stack sensor 84 is turned on in step S302 (YES in step S302), then in step S303, the CPU 150 waits until the stack sensor 84 is turned off. If the stack sensor 84 is turned off in step S303 (YES in step S303), then in step S304, the CPU 150 adds "12 to the count of the sheet counter CNT1. Next, in step S305, the CPU 150 confirms whether the sheet counter CNT1 has reached a predetermined number of sheets N. In step S305, if the count of the sheet counter CNT1 is smaller than N (NO in step S305), the process returns to step S302. When the count of the sheet counter CNT1 reaches N (YES in step S305), after the trailing edges of a predetermined amount of sheets pass through the stack sensor 84 in steps S306, S307, and S308, then in step S309, the CPU 150 stops the stacker discharge motor 95.

Figure 17:
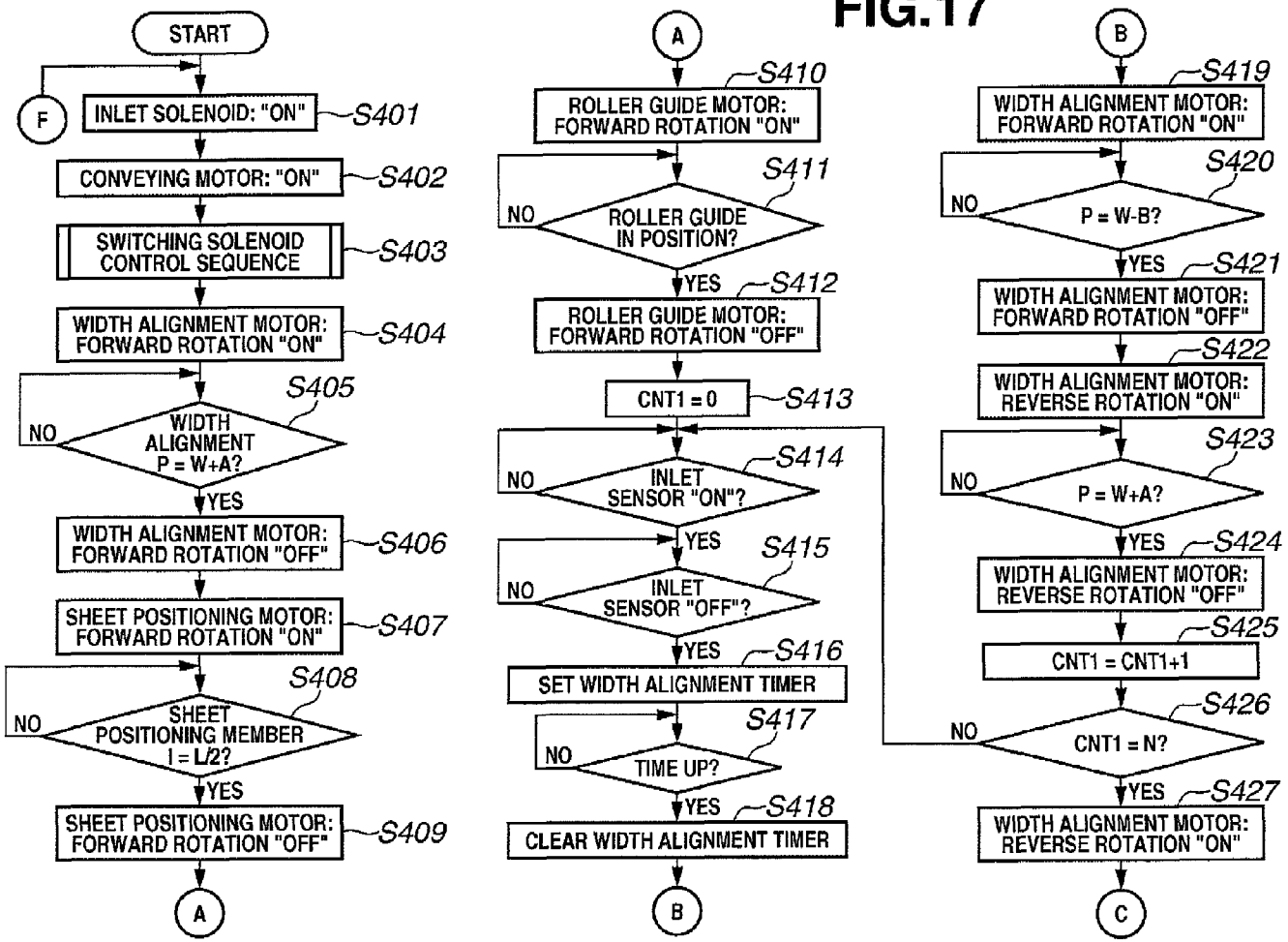
FIG. 17 is a flowchart illustrating example control of a width alignment mechanism portion according to an exemplary embodiment of the present invention.
Figure 18:
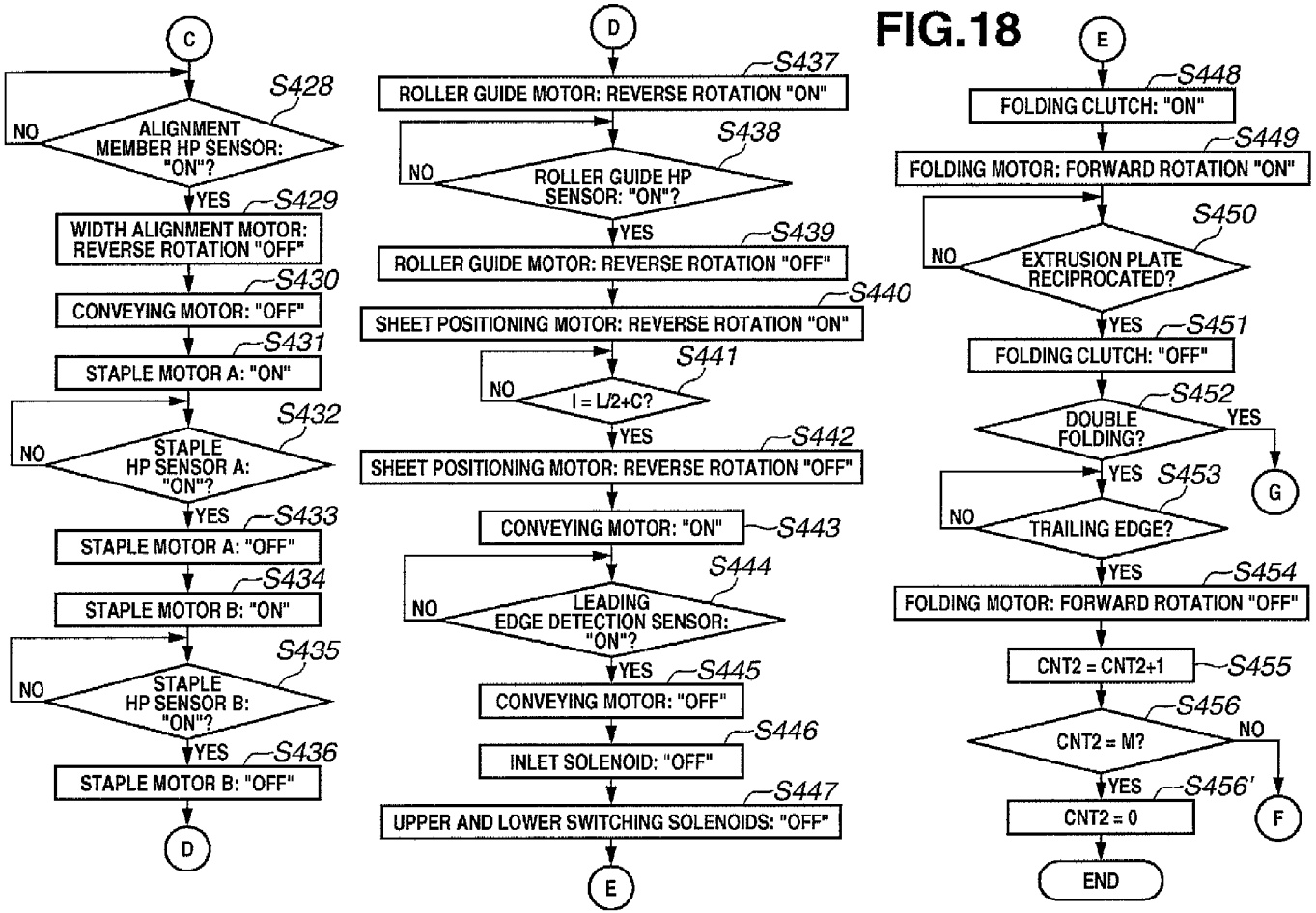
FIG. 18 is a flowchart illustrating example control of a folding operation of a bookbinding portion according to an exemplary embodiment of the present invention
Figure 19:
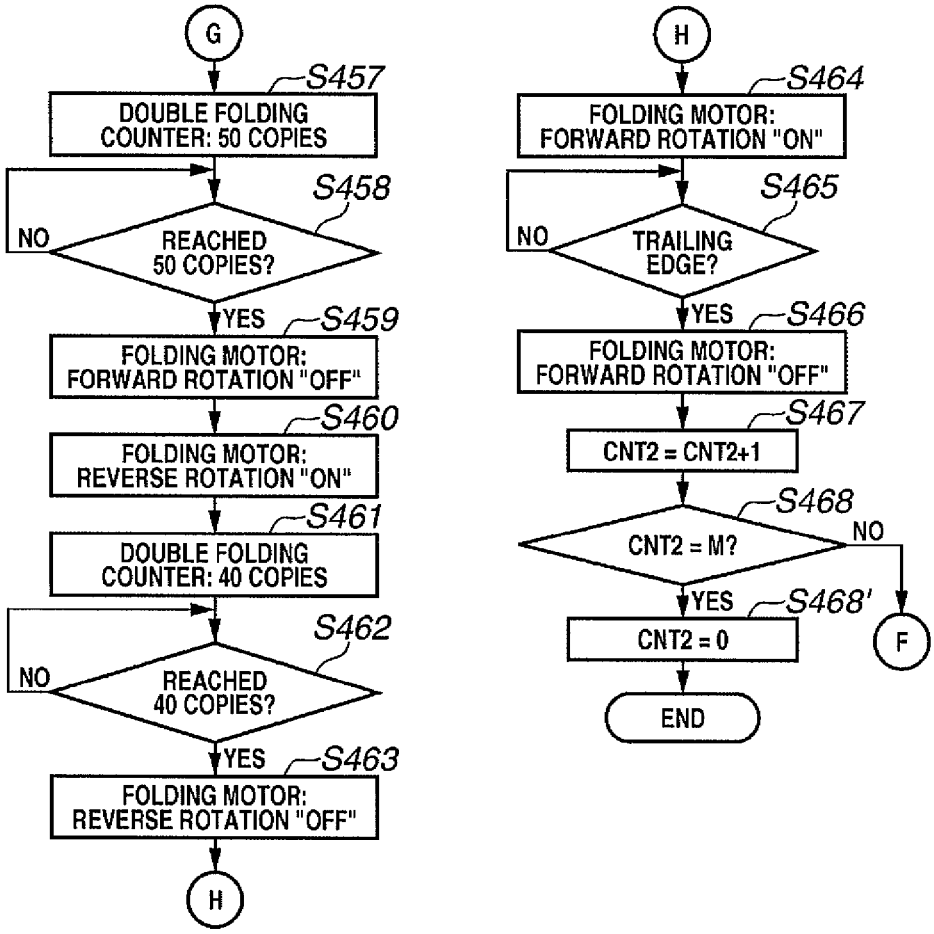
FIG. 19 is a flowchart illustrating example control of a double folding operation according to an exemplary embodiment of the present invention
Figure 20A:
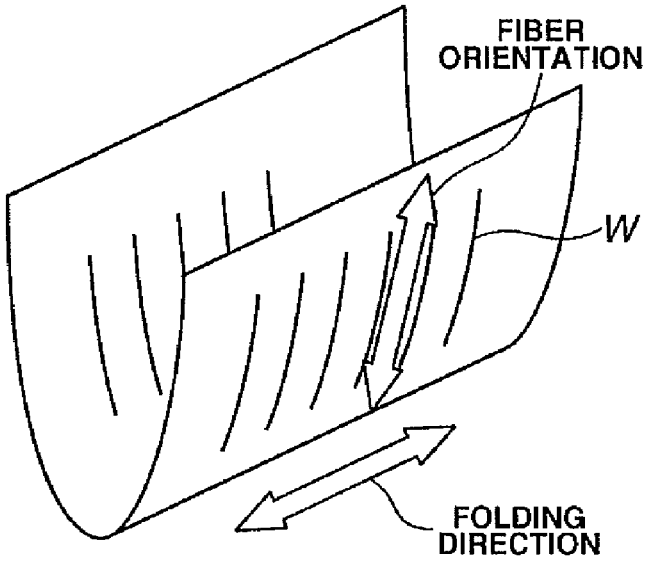
FIG.20A PRIOR ART
FIGS. 20A and 20B illustrate a relationship between a sheet folding direction and a sheet fiber orientation.
Figure 20B:
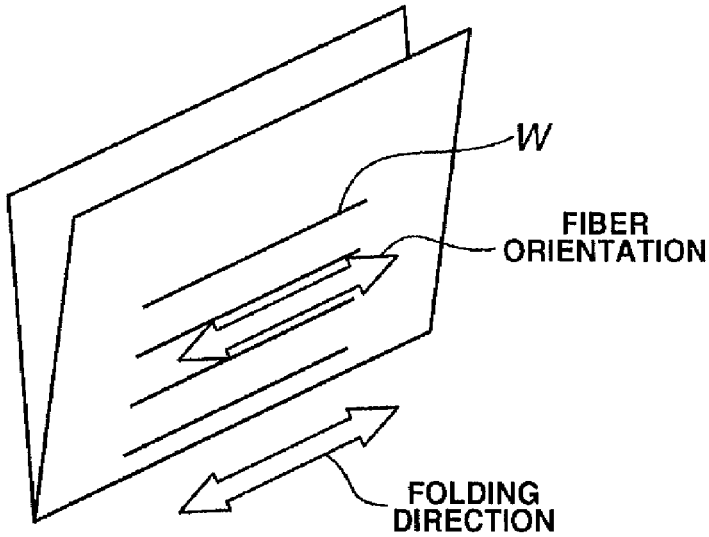
FIG.20B PRIOR ART

An example bookbinding mode sequence according to an exemplary embodiment of the present invention will be described now with reference to FIGS. 17 through 19. In FIG. 17, if the sheet has a size that allows binding, then in step S401, the CPU 150 activates the inlet solenoid 3*d* to open a path to the bookbinding mode. In step S402, the CPU 150 activates the conveying motor 51 to drive the conveyance rollers 13 and 14 and the semi-circular rollers 17*a* and 22*a* to convey the sheet.

In step S403, the CPU 150 controls the upper switching solenoid 15*d* and the lower switching solenoid 16*d*. In step S404, the CPU 150 directs the width alignment motor 24*d* to make a forward rotation so that a distance P between the width alignment members 24*a* and 24*b* becomes equal to the sheet width W plus "A" ("A" is a distance between the sheet and the width alignment member 24*a* or 24*b* and is generally about 10 mm). In step S405, if P=W+A (YES in step S405), then in step S406, the CPU 150 instructs the width alignment motor 24*d* to stop rotating.

In step S407, the CPU 150 directs the sheet positioning motor 61 to make a forward rotation. In step S408, if the sheet positioning member 23 reaches a position downstream of a staple point 19*a* of the stapler unit 18 where 1=L/2 (YES in step S408), then in step S409, the CPU 150 stops the forward rotation of the sheet positioning motor 61. In steps S410 and S411, the CPU 150 directs the roller guide motor 205 to make a forward rotation so that the roller guide 204*d* moves to a predetermined position where a conveyed sheet does not contact the folding rollers 26 and 27.

If the roller guide 204*d* moves from the home position to the predetermined position (YES in step S411), then the process proceeds to step S412. In step S412, the CPU 150 stops the forward rotation of the roller guide motor 205. Then, in step S413, the CPU 150 sets a sheet counter CNT1 to "0", and in step S414, the CPU 150 confirms a signal from the inlet sensor 83. If the CPU 150 receives a signal indicating that the inlet sensor 83 is turned off in step S415 (YES in step S415), then in step S416, the CPU 150 sets the width alignment timer so that the sheet is aligned at the time the leading edge of the sheet contacts the sheet positioning member 23, i.e., after a period of time t1 from turning-off of the inlet sensor 83, based on the sheet size information. In step S417, the CPU 150 waits until the width alignment timer reaches a predetermined time. When the predetermined time is reached (YES in step S417), in step S418, the CPU 150 clears the width alignment timer.

In step S419, the CPU 150 activates the width alignment motor 24*d* to rotate forward so that P=W−B ("B" is an amount of distance which the width alignment members 24*a* and 24*b* push the sheet and is generally about 2 mm). In step S420, if P=W−B, then in step S421, the CPU 150 stops the forward rotation of the width alignment motor 24*d*.

In step S422, in order to place the width alignment members 24*a* and 24*b* in position for the next sheet, the CPU 150 directs the width alignment motor 24*d* to make a reverse rotation. If P=W+A in step S423, then in step S424, the CPU 150 stops the reverse rotation of the width alignment motor 24*d*.

The above-described operations from steps S419 through S424 are performed during a short period of time when the semi-circular rollers 17*a* and 22*a* do not contact the elastic members 17*d* and 22*d* on the opposite side. In step S425, the CPU 150 adds "1" to the number of sheets counted by the sheet counter CNT1 until the count reaches a predetermined number N. When the number of sheets reaches N in step S426, then in step S427, the CPU 150 directs the width alignment motor 24*d* to make a reverse rotation. This rotation is continued until the width alignment members 24*a* and 24*b* return to their home positions, which are detected by the width alignment HP sensor 24*e* in step S428. If the width alignment HP sensor 24*e* determines that the width alignment members 24*a* and 24*b* have returned to their home positions, then in step S429, the CPU 150 stops the reverse rotation of the width alignment motor 24*d*, and in step S430, stops the conveying motor 51.

During steps S431 through S436, a plurality of sheets are stapled in two positions. In step S431, the CPU 150 activates the staple motor (A) 210. The staple motor (A) 210 continues to rotate until the staple HP sensor (A) 211 detects that the stapler unit 18 returns to its home position in step S432. In step S433, the CPU 150 stops the staple motor (A) 210 from rotating. In step S434, the CPU 150 activates the staple motor (B) 213. The staple motor (B) 213 continues to rotate until the staple HP sensor (B) 214 detects that the stapler unit 18 returns to its home position in step S435. In step S436, the CPU 150 stops the staple motor (B) 213 from rotating.

In step S437, in order to move the roller guide 201 to its home position to prepare for a folding operation, the CPU 150 directs the roller guide motor 205 to make a reverse rotation. The roller guide motor 205 continues to rotate in a reverse direction until the roller guide HP sensor 207 detects the roller guide 201 at its home position in step S438. In step S439, the CPU 150 stops the reverse rotation of the roller guide motor 205. Then, in step S440, the CPU 150 directs the sheet positioning motor 61 to make a reverse rotation. This rotation is continued until the sheet positioning member 23 is located at a predetermined position downstream of the stapler position 19*a* where 1=(L/2)+C ("C" is a distance between the stapler position 19*a* and the folding position) in step S441. In step S442, when the sheet positioning member 23 determines that the sheet positioning member 23 has moved to the predetermined position, the CPU 150 stops the reverse rotation of the sheet positioning motor 61.

In step S443, the CPU 150 continues to drive the conveying motor 51 until the sheets contact the sheet positioning member 23. In step S444, if the leading edge detection sensor 33 determines that the sheets have contacted the sheet positioning member 23, then in step S445, the CPU 150 stops the conveying motor 51. In step S446, the CPU 150 turns off the inlet solenoid 3*d*, and in step S447, the CPU 150 turns off the upper switching solenoid 15*d* and the lower switching solenoid 16*d*.

In step S448, the CPU 150 activates the folding clutch 74*a*, and in step S449, the CPU 150 activates the folding motor 64. By an engagement of the folding clutch 74*a*, the extrusion plate 25*a* starts to extrude and guides the sheets to the folding rollers 26 and 27.

In step S450, the CPU 150 continues to activate the folding clutch 74*a* until the extrusion plate position detection sensor 82 determines that the extrusion plate 25 has reciprocated once. If the extrusion plate position detection sensor 82 determines that the extrusion plate 25*a* has reciprocated once (YES in step S450), then in step S451, the CPU 150 turns off the folding clutch 74*a*.

In step S452, the folding operation mode selecting portion 223 of the CPU 150 selects an operation mode based on fiber orientation information and sheet information. If the single folding mode is selected (NO in step S452), then the process proceeds to step S453. With step S453, the process enters a control routine for the single folding mode. If the double folding mode is selected (YES in step S452), then the process proceeds to step S457 illustrated in FIG. 19. With step S457, the process enters a control routine for the double folding mode.

First, the single folding mode will be described. If the single folding mode is selected in step S452, then in steps S453 and step S454, the CPU 150 activates the folding motor 64 until the discharge sensor 29 detects the trailing edge of the folded sheet bundle. Then, in step S455, the CPU 150 adds "1" to the count of the counter CNT2. In step S456, if the count of the sheet counter CNT2 does not still reach a predetermined number M, the process returns to step S401. If the count of the sheet counter CNT2 reaches the predetermined number M (YES in step S456), the process proceeds to step S456'. In step S456', the CPU 150 resets the count of the sheet counter CNT2 to "0", and the process ends.

Next, the double folding mode will be described. In step S452, if the double folding mode is selected (YES in step S452), then in step S457, the CPU 150 sets a double folding counter to 50 pulses (cp). In step S458, the CPU 150 waits until the count of the double folding counter reaches 50 cp. Here, the double folding counter is set to 50 cp, which is based on a distance sheets slightly move after the sheets are pinched by the nip portion of the folding rollers 26 and 27. Thus, the value is not limited. Further, according to an exemplary embodiment of the present invention, the distance of the movement of the sheets is measured using pulse count. However, it may also be measured by a timer.

If the count of the double folding counter reaches 50 cp (YES in step S458), then the process proceeds to step S459. In step S459, the CPU 150 stops the forward rotation of the folding motor 64, and in step S460, the CPU 150 directs the folding motor 64 to make a reverse rotation. In step S461, the CPU 150 sets the double folding counter to 40 cp. Here, 40 cp corresponds to a distance sheets return after the sheets are pinched by the nip portion, or in other words, a distance that the sheets need to be returned. Thus, the value is not limited. Further, according to an exemplary embodiment of the present invention, the distance of the return movement of the sheets is measured using pulse count. However, it may also be measured by a timer.

In step S462, the CPU 150 returns the sheets until the count of the double folding counter reaches 40 cp. If the count of the double folding counter reaches 40 cp (YES in step S462), the process proceeds to step S463. In step S463, the CPU 150 stops the reverse rotation of the folding motor 64. In step S464, the CPU 150 directs the folding motor 64 to make a forward rotation, and the process proceeds to step S465. In step S465, if the discharge sensor 29 detects the trailing edge of the folded sheet bundle (YES in step S465), then in step S466, the CPU 150 stops the forward rotation of the folding motor 64. In step S467, the CPU 150 adds "1" to the count of the sheet counter CNT2. If the sheet counter CNT2 does not reach the predetermined number M in step S468 (NO in step S468), the process returns to step S401 illustrated in FIG. 17. If the sheet counter CNT2 reaches the predetermined number M (YES in step S468), then in step S468', the CPU 150 clears the sheet counter CNT2, and the operation ends.

As described above, folding conditions of sheets, such as single folding or double folding, are changed according to number of sheets, grammage, and fiber orientation based on the table illustrated in FIG. 4 Accordingly, a folded sheet bundle with a good bookbinding appearance can be acquired.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2006-339863 filed Dec. 18, 2006 and No. 2007-239304 filed Sep. 14, 2007, which are hereby incorporated by reference herein in their entirety.

What is claimed is:

1. A sheet processing apparatus comprising:

a folding portion configured to fold a sheet; and a controller configured to control a folding operation of the folding portion, wherein the controller controls a number of times of folding to be performed by the folding portion according to information on a sheet fiber orientation relative to a sheet folding direction so that the controller sets a number of times of folding to be performed by the folding operation when the sheet fiber orientation is orthogonal to the sheet folding direction greater than when the sheet fiber orientation is parallel to the sheet folding direction.

2. The sheet processing apparatus according to claim 1, further comprising a fiber orientation detecting device configured to detect the sheet fiber orientation.

3. The sheet processing apparatus according to claim 2, wherein the fiber orientation detecting device includes:

an emission unit configured to emit an electromagnetic wave to a conveyed sheet; and a detecting portion configured to detect at least one of an electromagnetic wave emitted from the emission unit and transmitted through the sheet or an electromagnetic wave emitted from the emission unit and reflected by the sheet, wherein the fiber orientation detecting device determines the sheet fiber orientation based on an intensity of at least one of the transmitted electromagnetic wave or the reflected electromagnetic wave.

4. The sheet processing apparatus according to claim 3, wherein the electromagnetic wave emitted from the emission unit includes a frequency ranging from 30 GHz to 30 THz.

5. The sheet processing apparatus according to claim 1 wherein the controller controls the folding operation of the folding portion based on a combination of the information on the sheet fiber orientation, a number of sheets to be folded, and grammage.

6. The sheet processing apparatus according to claim 1, wherein the folding portion includes a roller pair configured to rotate forward and backward to fold and convey at least one sheet, and wherein the controller selectively switches between a first folding mode for performing a single folding operation in which a sheet passes through the roller pair once and a second folding mode for performing a multiple folding operation in which a sheet passes through the roller pair a plurality of times.

7. The sheet processing apparatus according to claim 6, wherein the controller is capable of repeating the folding operation in the second folding mode a predetermined number of times.

8. The sheet processing apparatus according to claim 6, wherein the controller selects one of the first folding mode or the second folding mode based on a combination of the sheet fiber orientation, a number of sheets to be folded, and grammage.

9. The sheet processing apparatus according to claim 8, wherein the controller changes a reference number of sheets for switching between the first folding mode and the second folding mode based on whether the sheet fiber orientation is parallel or orthogonal to the sheet folding direction.

10. An image forming apparatus comprising:

an image forming portion configured to form an image on a sheet; and the sheet processing apparatus according to claim 1, the sheet processing apparatus being configured to process an image-formed sheet.

11. An image forming apparatus comprising:

an image forming portion configured to form an image on a sheet;

a fiber orientation detecting device configured to detect a fiber orientation of a sheet to be image-formed; and the sheet processing apparatus according to claim 1, the sheet processing apparatus being configured to process an image-formed sheet.

12. An image forming apparatus comprising:

an image forming portion configured to form an image on a sheet;

a sheet processing apparatus configured to process an image-formed sheet; and a controller configured to control the sheet processing apparatus, wherein the sheet processing apparatus comprises:

a sheet storing portion configured to store the image-formed sheet; and a folding portion configured to fold a sheet stored in the sheet storing portion, wherein the controller controls a folding operation of the folding portion based on information on a sheet fiber orientation relative to a sheet folding direction so that the controller sets a number of times of folding to be performed by the folding portion when the sheet fiber orientation is orthogonal to the sheet folding direction greater than when the sheet fiber orientation is parallel to the sheet folding direction.

13. The image forming apparatus according to claim 12, further comprising a fiber orientation detecting device configured to detect the sheet fiber orientation.

* * * * *